US008511789B2

(12) United States Patent
Ejiri et al.

(10) Patent No.: US 8,511,789 B2
(45) Date of Patent: Aug. 20, 2013

(54) PRINTER AND PRINTING SYSTEM

(75) Inventors: Keigo Ejiri, Nagano-ken (JP); Toshiaki Koike, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 48 days.

(21) Appl. No.: 13/074,190

(22) Filed: Mar. 29, 2011

(65) Prior Publication Data

US 2011/0175955 A1 Jul. 21, 2011

Related U.S. Application Data

(62) Division of application No. 11/555,096, filed on Oct. 31, 2006, now Pat. No. 7,950,766.

(30) Foreign Application Priority Data

Oct. 31, 2005 (JP) ..... 2005-316284
Dec. 16, 2005 (JP) ..... 2005-363318

(51) Int. Cl.
*B41J 29/393* (2006.01)

(52) U.S. Cl.
USPC ..... 347/19

(58) Field of Classification Search
USPC ..... 347/85–86, 19
See application file for complete search history.

(56) References Cited

U.S. PATENT DOCUMENTS 6,360,174 B1 3/2002 Shoki
6,361,138 B1 3/2002 Seino et al.
6,421,137 B1 7/2002 Endo
6,571,071 B2 5/2003 Kanoshima et al.
6,672,695 B1 1/2004 Naka et al.
6,969,136 B1 11/2005 Matsumoto et al.
7,950,766 B2 * 5/2011 Ejiri et al. ..... 347/19
2002/0022990 A1 * 2/2002 Kurata et al. ..... 705/14
2002/0073002 A1 6/2002 Horii et al.
2005/0039091 A1 2/2005 Hanaoka
2006/0045595 A1 3/2006 Hanaoka

FOREIGN PATENT DOCUMENTS

EP 1190859 A2 3/2002
EP 1300250 A2 4/2003
EP 1369246 A2 12/2003
JP 2000-019891 1/2000
JP 2000-020825 1/2000
JP 2000-198220 7/2000
JP 2000-309147 11/2000
JP 2001-63027 3/2001
JP 2001-71533 3/2001
JP 2001-228762 8/2001
JP 2002-36582 2/2002
JP 2002-164911 6/2002
JP 2002-174995 6/2002
JP 2002-215368 8/2002
JP 2002-283659 A 10/2002
JP 2002-318511 10/2002

(Continued)

*Primary Examiner* — Lamson Nguyen

(57) ABSTRACT

A printer 240 calculates the amount of ink used only for printing as a number of discharged ink shots, and sends this shot count with the printer serial number and ink cartridge ID to a server 220. The server 220 saves the shot count, printer serial number, ink cartridge ID, and an error correction code as status information. The server 220 or server upstream from the server 220 can reliably determine the number of ink shots used by the printer 240 only for printing from this status information.

9 Claims, 14 Drawing Sheets

(56) References Cited

FOREIGN PATENT DOCUMENTS

| | | |
|---|---|---|
| JP | 2002-326375 | 11/2002 |
| JP | 2003-022393 A | 1/2003 |
| JP | 2003-039795 | 2/2003 |
| JP | 2003-080693 | 3/2003 |
| JP | 2003-114596 | 4/2003 |
| JP | 2003-122209 | 4/2003 |
| JP | 2003-145886 | 5/2003 |
| JP | 2003-345560 | 12/2003 |
| JP | 2004-086689 | 3/2004 |
| JP | 2004-90517 | 3/2004 |
| JP | 2004-094554 | 3/2004 |
| JP | 2004-240836 | 8/2004 |
| JP | 2004-291574 | 10/2004 |
| JP | 2004-302955 | 10/2004 |
| JP | 2004-314642 | 11/2004 |
| JP | 2005-173500 | 6/2005 |
| JP | 2005-222161 | 8/2005 |
| JP | 2005-224980 | 8/2005 |

* cited by examiner

2006 July 1

| PRINTER SERIAL NUMBER | PREVIOUS COUNT | RECEIVED COUNT | DIFFERENCE | CURRENT COUNT |
|---|---|---|---|---|
| 1000123 | 0 | 454,329,404 | 454,329,404 | 454,329,404 |
| 1000209 | 0 | 504,315,000 | 504,315,000 | 504,315,000 |
| TOTAL | | | 958,644,404 | |

FIG. 13A

2006 August 1

| PRINTER SERIAL NUMBER | PREVIOUS COUNT | RECEIVED COUNT | DIFFERENCE | CURRENT COUNT |
|---|---|---|---|---|
| 1000123 | 454,329,404 | 863,225,868 | 408,896,464 | 863,225,868 |
| 1000209 | 504,315,000 | 1,059,061,500 | 554,746,500 | 1,059,061,500 |
| 1000154 | 0 | 453,883,500 | 453,883,500 | 453,883,500 |
| TOTAL | | | 1,417,526,464 | |

FIG. 13B

2006 September 1

| PRINTER SERIAL NUMBER | PREVIOUS COUNT | RECEIVED COUNT | DIFFERENCE | CURRENT COUNT |
|---|---|---|---|---|
| 1000123 | 863,225,868 | 1,362,988,212 | 499,762,344 | 1,362,988,212 |
| 1000209 | 1,059,061,500 | | | 1,059,061,500 |
| 1000154 | 453,883,500 | 998,543,700 | 544,660,200 | 998,543,700 |
| TOTAL | | | 1,044,422,544 | |

FIG. 13C

2006 October 1

| PRINTER SERIAL NUMBER | PREVIOUS COUNT | RECEIVED COUNT | DIFFERENCE | CURRENT COUNT |
|---|---|---|---|---|
| 1000123 | 1,362,988,212 | 1,726,451,735 | 363,463,523 | 1,726,451,735 |
| 1000209 | 1,059,061,500 | 1,765,102,500 | 706,041,000 | 1,765,102,500 |
| 1000154 | 998,543,700 | 1,361,650,500 | 363,106,800 | 1,361,650,500 |
| TOTAL | | | 1,432,611,323 | |

FIG. 13D

| INK CARTRIDGE ID | DATE SHIPPED | DATE OF FIRST USE | OUT-OF-INK DATE |
|---|---|---|---|
| 20060701001 | 2006/7/5 | 2006/8/10 | 2006/9/2 |
| 20060705045 | 2006/7/10 | 2006/8/18 | |
| 20060803104 | 2006/7/10 | | |
| 10060803285 | 2006/7/12 | | |

FIG. 14

PRINTER AND PRINTING SYSTEM

CROSS-REFERENCE TO RELATED APPLICATION(S)

This application is a divisional of, and claims priority under 35 U.S.C. §120 on, U.S. application Ser. No. 11/555,096, filed Oct. 31, 2006. The content of this related application is incorporated by reference herein in its entirety. Japanese patent application nos. 2005-316284 filed Oct. 31, 2005 and 2005-363318 filed Dec. 16, 2005 are also incorporated by reference herein in their entirety.

BACKGROUND

1. Field of Invention

The present invention relates generally to a printer and a printing system, and relates more particularly to a printer and a printing system that uses a cartridge that stores ink, toner, organic material for printing or other printing fluids or materials. To simplify the following discussion, the term "ink" will be used in the specification and the claims as a generic term that represents liquids or other materials for printing, such materials including ink, toner, organic materials and the like.

2. Description of Related Art

Printers such as inkjet printers and laser printers generally print text, pictures, or other content on plain paper, special paper, or other recording media by placing or fusing ink onto the recording medium. The ink is typically stored in a cartridge that can be freely installed in and removed from the printer. When the ink inside the cartridge is depleted in the course of using the printer, ink can be added by simply replacing the cartridge.

Printer manufacturers also usually supply the ink cartridges that are used in their printers to the end users, and are therefore also in the business of selling cartridges filled with ink.

More recently, manufacturers have developed new billing systems (printing systems) for charging the printer user based on the amount of ink consumed instead of selling individual cartridges.

Japanese Unexamined Patent Appl. Pub. 2000-309147, for example, discloses a billing system in which the printer stores information about the consumption of consumable supplies (such as how toner is consumed and how much paper is used) for each user ID. The printer then sends this consumption information to a data processing terminal when requested, and the data processing terminal calculates the printer usage fee according to a predetermined formula based on this consumption information.

Japanese Unexamined Patent Appl. Pub. 2004-90517 discloses an inkjet printer having a billing information management unit for managing ink usage. The billing information management unit calculates ink consumption based on the size and number of ink droplets discharged from the print head.

Japanese Unexamined Patent Appl. Pub. 2002-36582 discloses a billing system in which the inkjet printer uses optical sensors to measure how much ink remains in the ink cartridge, and calculates ink usage based on how much ink remains. A data processing device connected to the inkjet printer acquires data relating how much ink is used (referred to below as simply "ink usage") from the inkjet printer, and sends data relating to ink usage over a network to a server in a service center. The billing module that runs on the service center server then references an ink-billing table to calculate the billing amount based on ink usage and bills the user.

The following problems arise when these billing systems are actually installed and used, however.

The above billing system simultaneously manages plural printers and plural cartridges for plural users, and therefore requires a system that can identify each printer and each cartridge to acquire the ink usage information.

In businesses where this billing system is actually used, however, the billing system operator (the party providing the printer or cartridge) and the actual printer user are often in separate places. In the case of an inkjet printer, this requires constructing a system in which the user is only billed for the ink actually consumed from the specific ink cartridge provided by the operator to the user.

In order to reliably acquire ink usage data from a user in a remote location, it is also necessary to improve the reliability of the data acquired from the printer by, for example, preventing errors in the transmitted data.

In the operation of this billing system, the billing system operator must understand how ink cartridges are used in the remote location where the user is located, recover the depleted ink cartridges in a timely manner, and keep the user supplied with new ink cartridges filled with ink. The system operator must therefore reliably store accurate information relating to the depleted ink cartridges and what ink cartridges have been newly installed in the printer.

A server that is located in the service center and that handles the calculations could be used to receive and store the ink cartridge data received from the printer. However, if the service center server loses the ink cartridge data for some reason, the operator becomes unable to acquire data for the ink cartridge used by the user. Furthermore, because the operator cannot know when the depleted ink cartridges should be collected if the ink cartridge data cannot be acquired from the printer, filled ink cartridges cannot be supplied to the user when needed. This creates obvious business problems.

SUMMARY OF INVENTION

A printer and a printing system according to one aspect of the present invention separately manages a plurality of cartridges and maintains the reliability of the ink cartridge data acquired from the printer in a printer system that acquires data related to the usage of a ink such as ink from a printer.

A printer and printing system according to another aspect of the invention enables operating a printing system stably without loading cartridge information.

(1) A first aspect of the invention is a printer in communication with a data processing apparatus, the printer printing images based on commands received from the data processing apparatus, the printer comprising:

a data storage unit that stores information;

a cartridge compartment that holds a cartridge that stores ink;

a cartridge control unit that reads a cartridge identification number from a memory device contained in the cartridge and that stores the cartridge identification number in the data storage unit;

a transmission data generating unit that generates status information, which includes the cartridge identification number stored in the data storage unit; and a transmission unit that sends the status information to the data processing apparatus.

(2) A second aspect of the invention is the printer according to the first aspect of the invention further comprising:

an ink usage calculation unit that calculates an ink usage amount and that stores the ink usage amount in the data storage unit; and wherein the data storage unit stores a device identification number identifying the printer; and the transmission data generating unit generates status information including the cartridge identification number, the device identification number, and the ink usage amount.

(3) A third aspect of the invention is the printer according to first or second aspects of the invention wherein the cartridge control unit reads the cartridge identification number and stores the cartridge identification number and a designator representing a newly installed cartridge in the data storage unit when a cartridge is installed in the cartridge compartment.

(4) A fourth aspect of the invention is the printer according to any of the first to third aspects of the invention wherein the cartridge control unit reads the cartridge identification number when the amount of ink inside the cartridge becomes less than or equal to a predetermined level, and stores the cartridge identification number and a designator representing a cartridge that is out of ink.

(5) A fifth aspect of the invention is the printer according to any of the first to fourth aspects of the invention wherein the cartridge control unit retains the cartridge identification number stored in the data storage unit when the transmission unit sends the status information to the data processing apparatus, sets a transmission status of the cartridge identified by the transmitted cartridge identification number to denote sent, and stores the transmission status in the data storage unit.

(6) A sixth aspect of the invention is the printer according to the fifth aspect of the invention wherein the cartridge control unit deletes from the data storage unit a cartridge identification number of a cartridge for which the transmission status is set to denote sent, and stores the cartridge identification number of a newly installed cartridge in the data storage unit.

(7) A seventh aspect of the invention is the printer according to the fifth or sixth aspect of the invention wherein a storage capacity limit is set for cartridge identification numbers that can be stored in the data storage unit, and the cartridge control unit executes an error handling process if storage of cartridge identification numbers reaches the storage capacity limit and all transmission status flags are not set to denote sent when storing a cartridge identification number.

(8) An eighth aspect of the invention is the printer according to any of the first to seventh aspects of the invention wherein:

the cartridge stores a plurality of inks; and the ink usage calculation unit calculates an ink usage amount for each of the inks and stores in the data storage unit the ink usage amount for each of the inks.

(9) A ninth aspect of the invention is the printer according to any of the first to eighth aspects of the invention wherein:

the ink usage calculation unit calculates the ink usage amount by counting the number of ink shots discharged.

(10) A tenth aspect of the invention is the printer according to the ninth aspect of the invention wherein the ink usage calculation unit disregards the amount of ink used to enable the print head to discharge ink when calculating the ink usage amount.

(11) An eleventh aspect of the invention is a printing system comprising:

a data processing apparatus; and a printer in communication with the data processing apparatus, the printer printing images based on commands received from the data processing apparatus, wherein the printer comprises:

a data storage unit that stores information;

a cartridge compartment that holds a cartridge that stores ink;

a cartridge control unit that reads a cartridge identification number from a memory device contained in the cartridge and that stores the cartridge identification number in the data storage unit;

a transmission data generating unit that generates status information including the cartridge identification number stored in the data storage unit; and a transmission unit that sends the status information to the data processing apparatus.

(12) A twelfth aspect of the invention is the printing system described in the eleventh aspect of the invention wherein the printer further comprises:

an ink usage calculation unit that calculates an ink usage amount and that stores the ink usage amount in the data storage unit; and wherein the data storage unit stores a device identification number identifying the printer; and the transmission data generating unit generates status information including the cartridge identification number, the device identification number, and the ink usage amount.

(13) A thirteenth aspect of the invention is the printing system described in the eleventh or twelfth aspect of the invention wherein the data processing apparatus comprises a status acquisition unit that requests the printer to send status information and that receives the status information from the printer.

(14) A fourteenth aspect of the invention is the printing system described in the thirteenth aspect of the invention wherein the status acquisition unit adds an error correction code for maintaining data reliability to the status information.

(15) A fifteenth aspect of the invention is the printing system described in any of the eleventh to fourteenth aspects of the invention further comprising:

a terminal device connected by a network to the data processing apparatus and wherein the data processing apparatus sends the status information to a terminal device, and the terminal device calculates an ink usage fee based on the status information.

(16) A sixteenth aspect of the invention is the printing system described in the eleventh aspect of the invention wherein the data processing apparatus comprises an ink usage acquisition unit that requests the ink usage amount from the printer and receives the ink usage amount from the printer.

(17) A seventeenth aspect of the invention is the printing system described in any of the eleventh to sixteenth aspects of the invention wherein the cartridge control unit reads the cartridge identification number and stores the cartridge identification number and a designator representing a newly installed cartridge in the data storage unit when a cartridge is installed in the cartridge compartment.

(18) An eighteenth aspect of the invention is the printing system described in any of the eleventh to seventeenth aspects of the invention wherein the cartridge control unit reads the cartridge identification number when the amount of ink inside the cartridge becomes less than or equal to a predetermined level, and records the cartridge identification number and a designator representing a cartridge that is out of ink.

(19) A nineteenth aspect of the invention is the printing system described in any of the eleventh to eighteenth aspects of the invention wherein the cartridge control unit retains the cartridge identification number stored in the data storage unit when the transmission unit sends the status information to the data processing apparatus, sets a transmission status of the cartridge identified by the transmitted cartridge identification number to denote sent, and stores the transmission status in the data storage unit.

(20) A twentieth aspect of the invention is the printing system described in the nineteenth aspect of the invention wherein the cartridge control unit deletes from the data storage unit a cartridge identification number of a cartridge for which the transmission status is set to denote sent, and stores the cartridge identification number of a newly installed cartridge in the data storage unit.

(21) A twenty-first aspect of the invention is the printing system described in the nineteenth or twentieth aspects of the invention wherein a storage capacity limit is set for cartridge identification numbers that can be stored in the data storage unit, and the cartridge control unit executes an error handling process if storage of cartridge identification numbers reaches the storage capacity limit and all transmission status flags are not set to denote sent when storing a cartridge identification number.

(22) A twenty-second aspect of the invention is the printing system described in any of the eleventh to twenty-first aspects of the invention wherein:

the cartridge stores a plurality of inks; and the ink usage calculation unit calculates an ink usage amount for each of the inks and stores in the data storage unit the ink usage amount for each of the inks.

(23) A twenty-third aspect of the invention is the printing system described in any of the eleventh to twenty-second aspects of the invention wherein:

the ink usage calculation unit calculates the ink usage amount by counting a number of ink shots discharged.

(24) A twenty-fourth aspect of the invention is the printing system described in the twenty-third aspect of the invention wherein the ink usage calculation unit disregards the amount of ink used to enable the print head to discharge ink when calculating the ink usage amount.

With the printer and printing system according to the present invention the printer sends a cartridge identification number to the data processing apparatus. The data processing apparatus or the terminal device connected upstream from the data processing apparatus can determine which of a plurality of cartridges were actually used. As a result, the system operator can know which of the cartridges that were provided to the user were actually used, and can invoice the user for only the portion that was actually used.

A data processing apparatus as used herein is not particularly limited insofar as the data processing apparatus can communicate with and control the printer. The data processing apparatus can, for example, be a server, a general purpose terminal device or computer (such as a PC) for controlling a printer, or a POS terminal for controlling a printer to print journals, receipts, tickets, coupons, tags, or other media.

With the printer and printing system according to the present invention the printer sends a device identification number and the amount of ink used only for image recording to the data processing apparatus. If a plurality of printers is connected to the data processing apparatus, the data processing apparatus or the terminal device connected upstream to the data processing apparatus can determine how much ink was used only for printing by each of the printers. When a plurality of printers are used in a billing system that charges customers based on how much ink was used, ink usage can be determined individually for each printer, data from all printers can be gathered and tabulated, and the user can be billed based on ink usage.

With the printer and printing system according to the present invention the printer sends the device identification number and the amount of ink used only for printing together with the cartridge identification number to the data processing apparatus. When multiple printers are connected to the data processing apparatus, the data processing apparatus or the terminal device upstream from the data processing apparatus can know which cartridge is installed in each printer and how much ink was consumed. Therefore, how much ink is used from each cartridge can therefore be determined even when the ink billing system tracks ink by a plurality of printers.

Furthermore, by collecting and tabulating data from all of the printers, the ink billing system can determine if there is a cartridge that was supplied to the user but is not being used. If there are cartridges that are being used abnormally can also be determined, such as when a cartridge is still being used even though the ink should already have been depleted.

With the printer and printing system according to the present invention the cartridge control unit of the printer reads the cartridge identification number, stores the cartridge identification number with as designator representing a newly installed cartridge, and sends the cartridge identification number to the data processing apparatus when a cartridge is installed in the cartridge installation unit. The data processing apparatus can therefore reliably determine when which cartridge was installed in which printer. The data processing apparatus can also know when a cartridge is moved from one printer to another printer.

When the ink billing system covers multiple printers, the ink billing system can determine the usage of each cartridge, and by tabulating data received from all printers can reliably determine if a supplied cartridge has not been installed in a printer.

With the printer and printing system according to the present invention the cartridge control unit of the printer reads the cartridge identification number and registers the cartridge identification number in the data storage unit with a designator representing an empty cartridge when the amount of ink inside the cartridge being used in the cartridge installation unit drops below a predetermined level, and later sends the cartridge identification number to the data processing apparatus. The data processing apparatus can therefore reliably know when which cartridge ran out of ink (that is, became empty).

Furthermore, when the ink billing system covers multiple printers, the ink billing system can determine the usage of each cartridge, and by tabulating data received from all printers can reliably determine if a cartridge that is depleted of ink (is empty) has not been returned.

With the printer and printing system according to the present invention the cartridge control unit of the printer holds the cartridge identification numbers that were sent to the data processing apparatus in the data storage unit instead of erasing the cartridge identification numbers, and stores the cartridge identification number read from the memory device of a newly installed cartridge in the data storage unit by adding the cartridge identification number.

If the cartridge identification numbers received by the data processing apparatus are later lost due to a problem such as the data processing apparatus crashing after the cartridge identification numbers have been received, the data processing apparatus can retrieve the required cartridge identification numbers by again sending a transmission request to the printer because the cartridge identification numbers sent to the data processing apparatus remain stored by the printer. More specifically, because the cartridge identification numbers are always stored by either the printer or the data processing apparatus, the cartridge identification numbers will not be lost even if there is a problem with the printing system, and stable printing system operation can therefore be maintained.

With the printer and printing system according to the present invention the printer holds the cartridge identification numbers that were sent to the data processing apparatus in the data storage unit instead of erasing the cartridge identification numbers, and sets the transmission status of the transmitted cartridge identification numbers to a "sent" state. Cartridge identification numbers that were sent and cartridge identification numbers that have not been sent can therefore be distinguished. More specifically, the printer can distinguish cartridge identification numbers that are stored in the data storage unit and must be kept in the data storage unit (that is, are write-protected) because they have not been sent to the data processing apparatus from cartridge identification numbers that have already been sent to the data processing apparatus and can therefore be erased if needed (are not write-protected), and can therefore prevent adding and storing (overwriting) a newly read cartridge identification number to an address where a write-protected cartridge identification number is stored.

With the printer and printing system according to another aspect of the present invention the printer erases (or overwrites) the cartridge identification number for a cartridge for which the transmission status is set to send and then stores a newly read cartridge identification number. The invention can therefore also be used when the storage capacity available for storing cartridge identification numbers in the data storage unit is limited and a cartridge identification number that exceeds this storage capacity must be stored. The invention can therefore be used with a printer that stores many cartridge identification numbers because the printer uses a different cartridge for each of multiple colors. Furthermore, until the available storage capacity of the data storage unit is exceeded, cartridge identification numbers that have already been sent to the data processing apparatus can be kept in memory by the printer so that the data processing apparatus can acquire previously received cartridge identification numbers as many times as needed.

With the printer and printing system according to another aspect of the invention the printer executes an error handling process if storage of cartridge identification numbers reach the storage capacity limit and all transmission status flags are not set to denote sent. If due to some problem the storage capacity of the data storage unit becomes full before the cartridge identification numbers stored in the data storage unit have been sent to the data processing apparatus, an error handling process can thus be executed without deleting or overwriting data. Therefore, cartridge identification numbers that have not been sent to the data processing apparatus can therefore be reliably stored in memory. An error can also be reported to the user so that the user can have the printer repaired or inspected to keep the printing system operating smoothly.

With the printer and printing system according to another aspect of the invention each cartridge stores a plurality of inks, the ink usage calculation unit calculates for each of the plural inks and stores in the data storage unit the amount of ink used only for image recording, and this information is later sent to the data processing apparatus. Even when each cartridge contains a plurality of inks, the data processing apparatus can therefore reliably determine ink usage.

When the ink billing system is used with a plurality of printers, consumption of each ink in each cartridge can be determined, and by tabulating data received from all printers, which ink is used the most from each cartridge can be statistically determined. When cartridges are then replaced, the cartridges can be provided according to how much each ink is used. If a different cartridge is used for each ink, more cartridges containing the most commonly used ink can be provided. When a plurality of inks is stored in one cartridge, cartridges with greater capacity for the more commonly used ink can be selectively provided.

With the printer and printing system according to another aspect of the invention the ink is ink and the ink usage calculation unit determines ink usage based on the number of discharged ink shots. By thus counting the number of ink shots, the amount of ink that is used only for printing can be reliably determined. As a result, the user can be reliably billed for the amount of ink actually used for printing.

The ink usage calculation unit in the printer and printing system according to the present invention does not count as part of the ink usage ink that is consumed to maintain the print head in normal operating condition, that is, ink that is consumed for cleaning operations, recover clogged nozzles, or charging the ink path. As a result, only the ink that is used for actually printing can be reliably calculated.

In a printing system according to the present invention the data processing apparatus has a status acquisition unit for requesting the printer to send the status information and receiving the status information from the printer. The printer can therefore send the status information to the data processing apparatus at a desired time in response to the request from the status acquisition unit.

The status acquisition unit in the printing system according to another aspect of the invention adds an error correction code for maintaining data reliability to the received status information. If the status information is changed in some way after being generated, the presence of a change can be detected when received by the data processing apparatus by using the error correction code. When the printing system of the invention is used in a ink billing system, the reliability of the status information received from the printers can therefore be improved, changes resulting from communication errors or tampering can be prevented, and the reliability of the ink billing system can be improved.

With the printing system according to the present invention the status information is transferred from the data processing apparatus over a network to the terminal device maintained by the cartridge supplier that supplies cartridges to the printing system, and the terminal device calculates the ink usage fee based on the status information. The cartridge supplier can therefore bill the printer user for the amount used. By thus acquiring status information from the printer and transferring the information to the cartridge supplier, an ink billing system that is realistic and highly reliable can be provided.

The data processing apparatus in a printing system according to another aspect of the invention has an ink usage acquisition unit for requesting how much ink was used by the printer and acquiring how much ink was used from the printer. How much ink was used is therefore reported by the printer and can be confirmed by the data processing apparatus whenever the data processing apparatus wants to know how much ink was used.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

FIG. 13A to FIG. 13D show examples of the ink shot counts in the billing status information received from the main server by the printer manufacturer.

FIG. 14 is a table of ink cartridge IDs in the billing status information received by the printer manufacturer from the main server (company X).

DESCRIPTION OF THE PREFERRED EMBODIMENTS

Preferred embodiments of a printer and printing system according to the present invention are described below with reference to the accompanying figures. Embodiments of a printer and printing system according to the present invention that use a cartridge that stores ink are described in detail below with reference to a billing system in which the printer and printing system are used. As mentioned previously, to simplify the following discussion, the term "ink" will be used in the specification and the claims as a generic term that represents liquids or other materials for printing, such materials including ink, toner, organic materials and the like.

Ink Billing System Description

Figure 1:
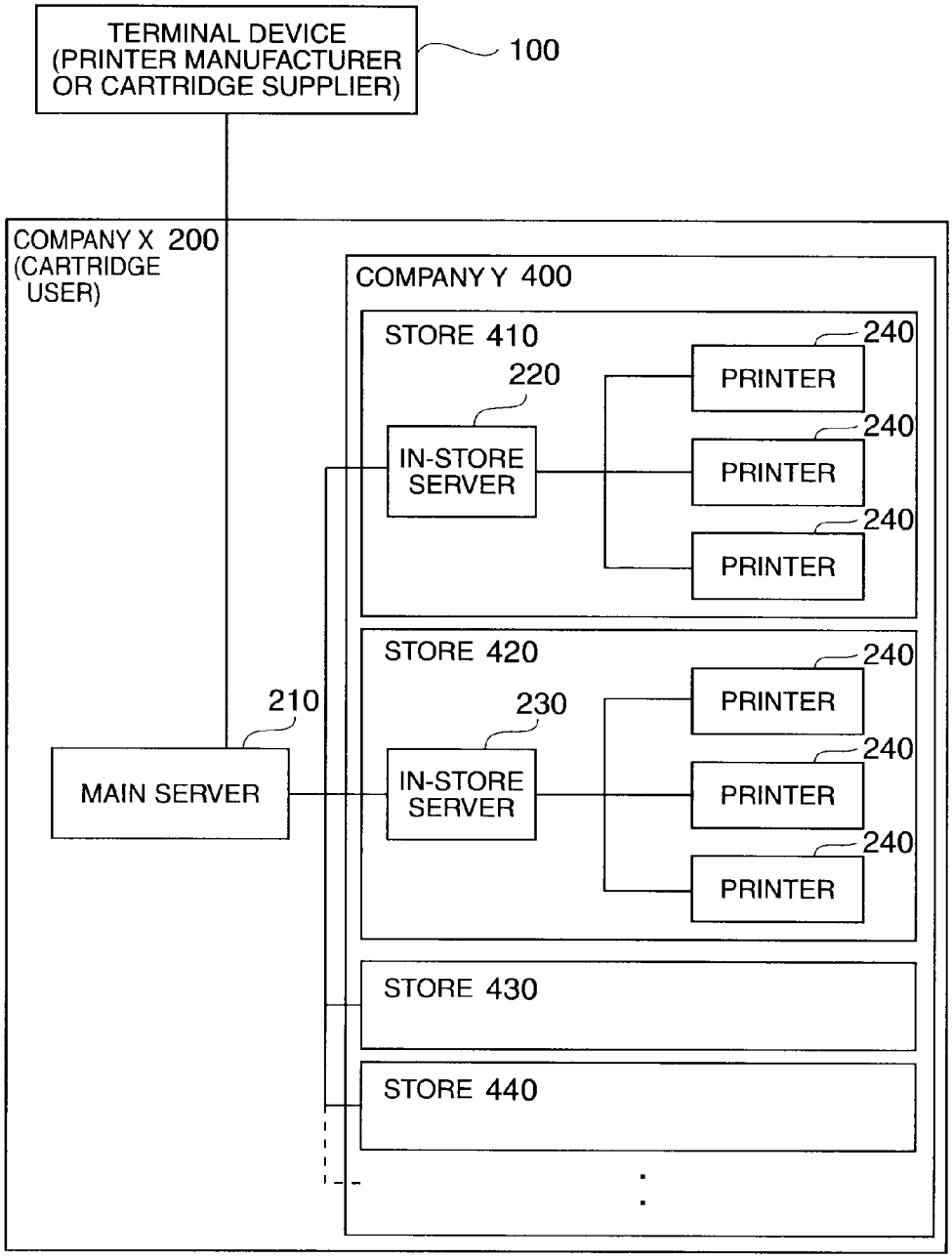
FIG. 1 is a block diagram of an ink billing system for billing for ink usage using a printer and printing system according to the present invention.
Figure 2:
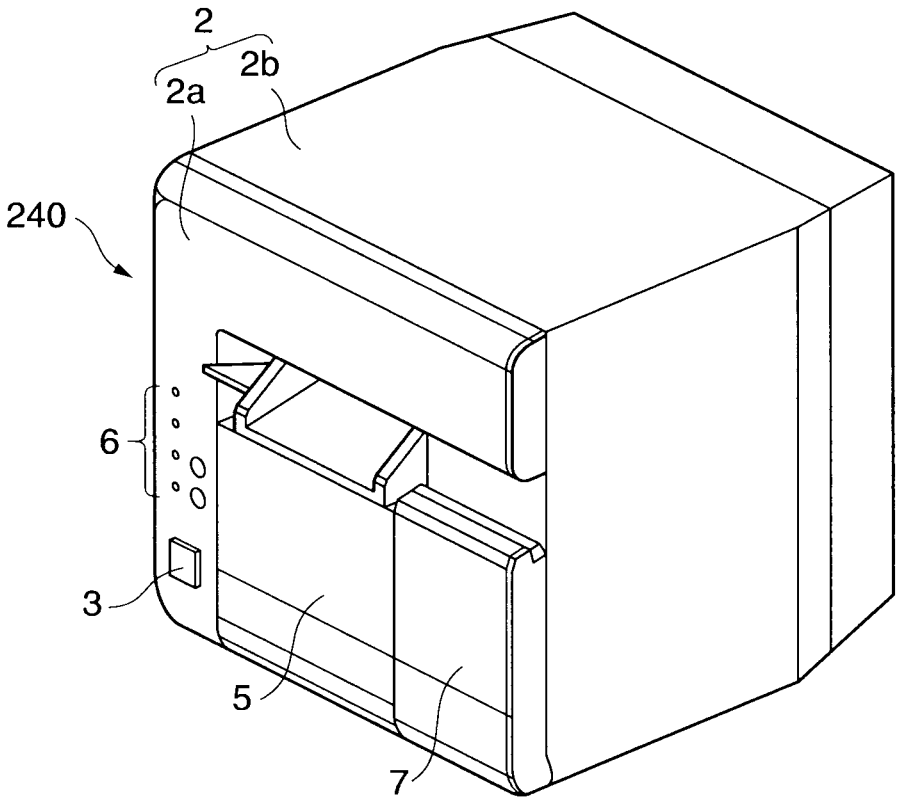
FIG. 2 is an external oblique view of a printer according to a preferred embodiment of the invention.
Figure 3:
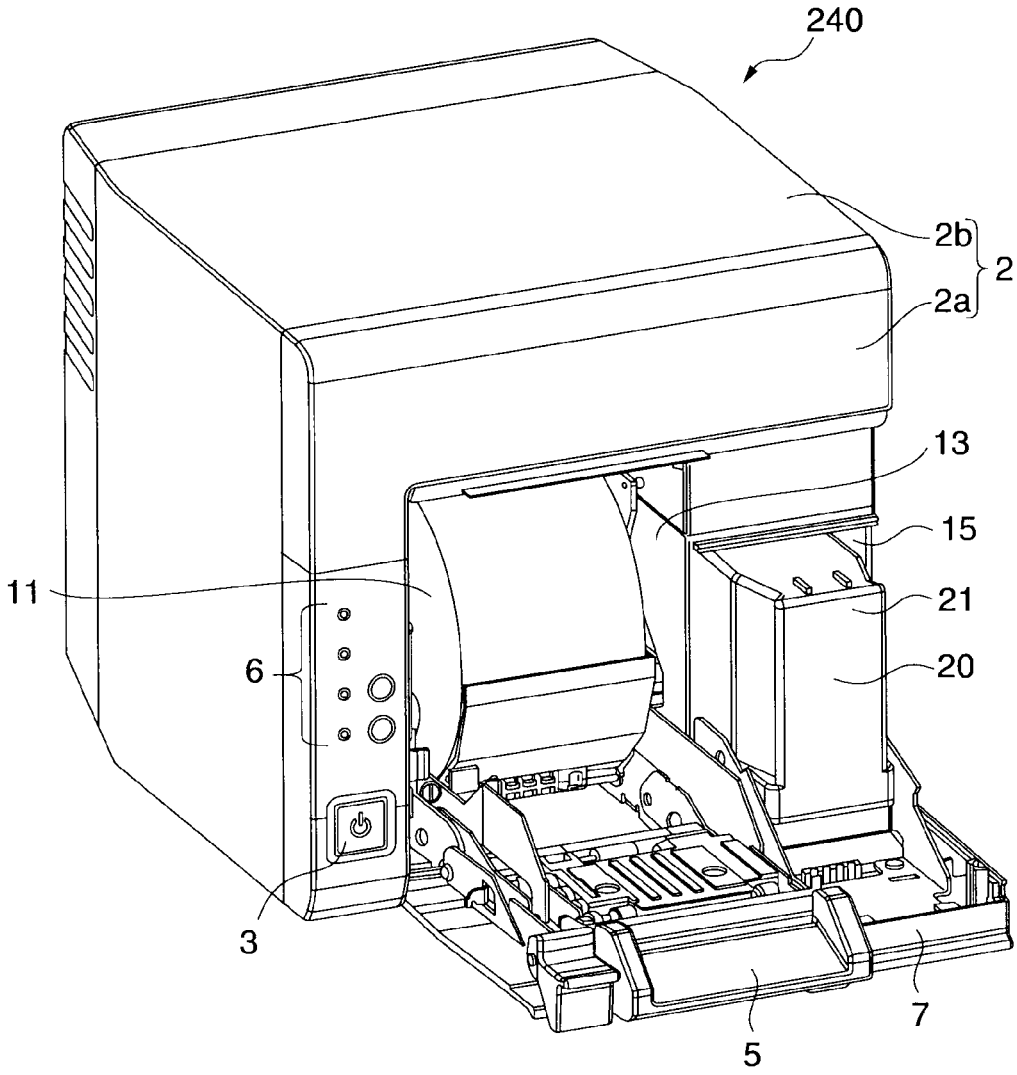
FIG. 3 is an external oblique view of a printer according to a preferred embodiment of the invention with the two front covers open to reveal the inside of the printer.
Figure 4:
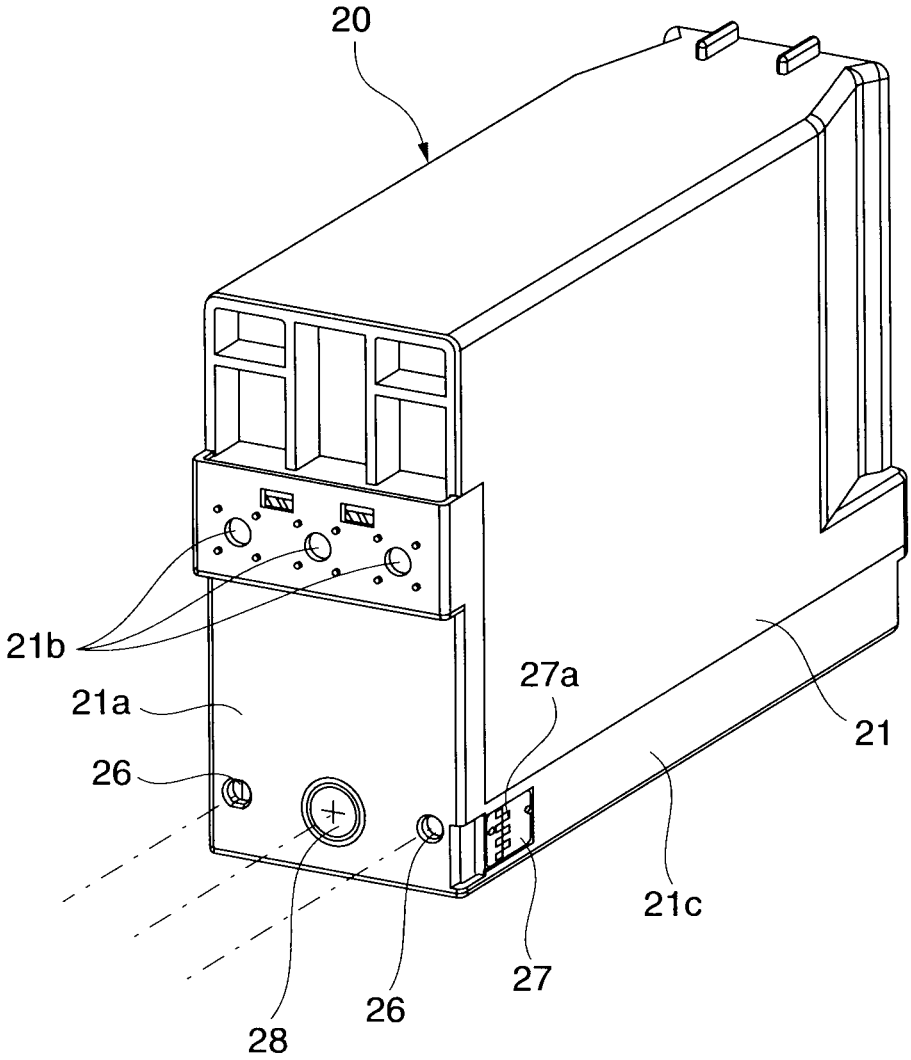
FIG. 4 is an oblique view of an ink cartridge that is installed in the printer according to the present invention.

FIG. 1 is a block diagram showing an ink billing system that uses a printer and a printer system according to the present invention to bill users for the amount of ink used. FIG. 2 is an external oblique view of a printer according to this embodiment of the invention, FIG. 3 is an external oblique view of the printer with the front covers opened to show the inside of the printer, and FIG. 4 is an oblique view of an ink cartridge that is installed in the printer in this embodiment of the invention.

In an ink billing system according to this embodiment of the invention, a terminal device 100 run by the printer manufacturer (the supplier of cartridges containing the ink) manages the supply of cartridges filled with ink to company X 200 (the cartridge user), which has purchased a plurality of color inkjet printers 240, and company X 200 pays an ink fee through the terminal device 100 of the printer manufacturer according to the amount of ink that was used for printing by the printers 240.

In this ink billing system, company X 200 is a company that issues coupons for particular products and obtains advertising income according to the number of coupons issued. Company X 200 installs an in-store server (data processing system) 220, 230 and a plurality of printers 240 purchased from the printer manufacturer in a plurality of stores 410 to 440 that are owned or managed by company Y 400 (such as a customer of company X 200) (only the in-store server and printers in stores 410 and 420 are shown in FIG. 1 for brevity). Each printer 240 is in communication by a LAN with the in-store server 220, 230.

Company Y 400 in this example is a supermarket or other retailer. The printers 240 can be printers for printing receipts, but are described as a different kind of printer in this embodiment of the invention. More particularly, the printers 240 are installed near each POS terminal in each store 410 to 440 as printers for printing coupons. Each printer 240 is configured to issue coupons, for example, linked to specific product information input from the POS terminal according to instructions from the in-store server 220, 230 installed in the same store. The issued coupons are then handed to the customer by the POS terminal operator of company Y 400.

The main server 210 is maintained by company X 200, and is in communication over a private or public communication network such as the Internet with each of the in-store servers 220, 230 located in the stores 410 to 440. The main server 210 sends product information to the in-store servers 220, 230. The main server 210 is also used to manage the product information, and sends data used to print the coupons that are output by the printers 240 in conjunction with the product information, and receives from the in-store servers 220, 230 information about the type and number of coupons issued by the printers 240, for example.

The printer manufacturer in this ink billing system supplies ink cartridges ("cartridges" below) containing ink to company X according to demand. Demand can be predicted by the terminal device 100 run by the printer manufacturer based on ink usage by the user. The printers 240 are installed at the checkout counters with the POS terminals in company Y 400. The ink cartridges supplied by company X 200 are installed in the printers 240. A scanner located at the POS terminal scans the barcode including a product code affixed to each product, and the in-store server 220, 230 then acquires product information corresponding to each product code and determines if there is coupon information to be printed. If there is coupon information to be printed, the server sends appropriate print data to the printer 240 to issue a coupon. The in-store server 220, 230 in each of the stores 410 to 440 regularly collects information relating to ink usage from each of the connected printers 240 and sends the information to the main server 210.

The main server 210 then sends the ink usage information for the printers 240 collected in the main server 210 over a network to a terminal device 100 operated by the printer manufacturer. The ink usage information collected in the main server 210 could alternatively be recorded on a CD (Compact Disc), DVD (Digital Versatile Disc), or other data storage medium that is then delivered to the printer manufacturer. The printer manufacturer or terminal device 100 then tabulates the ink usage information received from company X 200 and periodically bills company X 200 for the ink usage. The company X 200 also returns empty ink cartridges collected from company Y 400 to the printer manufacturer. The printer manufacturer refills the returned ink cartridges and then returns the refilled ink cartridges to company X 200.

The ink billing system according to this embodiment of the invention only bills for the amount of ink used for printing coupons and other content. Ink that is not used for printing includes, for example, ink that is consumed by cleaning processes, print head recovery processes, and ink supply replenishing operations, including the ink that is used to flush the nozzles and ink that is vacuumed from the nozzles as part of print head nozzle maintenance. More specifically, there is no charge for ink that is consumed by operations that are run so that ink can be discharged from the print head. An advantage of this system is therefore that company X 200 does not need to pay for ink that is not used to print the coupons.

Printer Configuration

The configuration of a printer 240 in this embodiment of the invention is described next.

A printer 240 according to this embodiment of the invention as shown in FIG. 2 and FIG. 3 is a color printer that uses plural inks, i.e. different colors of ink, to print images on roll paper used as the recording medium and to issue coupons.

As shown in FIG. 2 a printer 240 according to this embodiment of the invention has a power switch 3, roll paper cover 5, and an ink cartridge compartment cover 7 located from left to right at the front of the printer case 2, which includes a front top panel 2*a* and a printer case cover 2*b*. Above the power switch 3 are a plurality of LED indicators 6 for reporting information about the printer status to the user. The roll paper cover 5 and ink cartridge compartment cover 7 can each pivot forward on a hinge (not shown) positioned at the bottom part of each cover to open and close.

Opening the roll paper cover 5 opens the paper compartment 13 in which the roll paper 11 used as the printing paper is stored as shown in FIG. 3. The roll paper 11 can be replaced when the roll paper cover 5 is thus opened.

Opening the ink cartridge compartment cover 7 provides access to the cartridge compartment 15, and enables loading and replacing the ink cartridge 20 in the cartridge compartment 15.

The ink cartridge 20 in this embodiment is a single package containing three color ink packs, one containing yellow, one cyan, and one magenta ink, inside the cartridge case 21. In a printer 240 according to this embodiment the ink cartridge 20 inside the cartridge compartment 15 slides between the cartridge replacement position and the cartridge usage position in conjunction with opening and closing the ink cartridge compartment cover 7.

As shown in FIG. 4, two positioning holes 26 are formed at the bottom part of the back 21*a* of the ink cartridge 20. When an ink cartridge 20 is loaded into the cartridge compartment 15 of the printer 240, the ink cartridge 20 is guided to and held in position by these positioning holes 26 sliding on positioning pins, not shown. Three ink supply openings 21*b* are also formed in the middle of the back 21*a*, and the three inks inside the ink cartridge 20 are supplied through these ink supply openings 21*b* to the printer 240.

A waste ink recovery opening 28 located between the positioning holes 26 is used to recover waste ink that is used for print head cleaning, clogged nozzle recovery, and ink supply replenishing, that is, ink that is not used by the printer 240 for printing but is used instead to maintain the print head in printing condition so that ink can be properly discharged from the print head. Waste ink is recovered through this waste ink recovery opening 28 into the ink cartridge 20. An ink cartridge 20 according to this embodiment of the invention thus functions both as an ink tank for supplying ink and a waste ink tank for collecting and holding waste ink.

A memory device 27 is embedded in one side 21*c* of the ink cartridge 20 with the surface of the contact pins 27*a* exposed. This memory device 27 is a rewritable nonvolatile memory device such as flash ROM that stores a cartridge ID (cartridge identification information) or other information for identifying the particular ink cartridge. The memory device 27 is electrically connected by the exposed contact pins 27*a* to matching pins (not shown) located in the cartridge compartment 15 of the printer 240, thereby enabling the printer 240 to write data into the memory device 27.

Relationship Between the in-Store Server and Printers

The relationship between the in-store server 220 (230) and printers 240 of the printing system according to this embodiment of the invention is described next with reference to FIG. 5 and FIG. 6.

Figure 5:
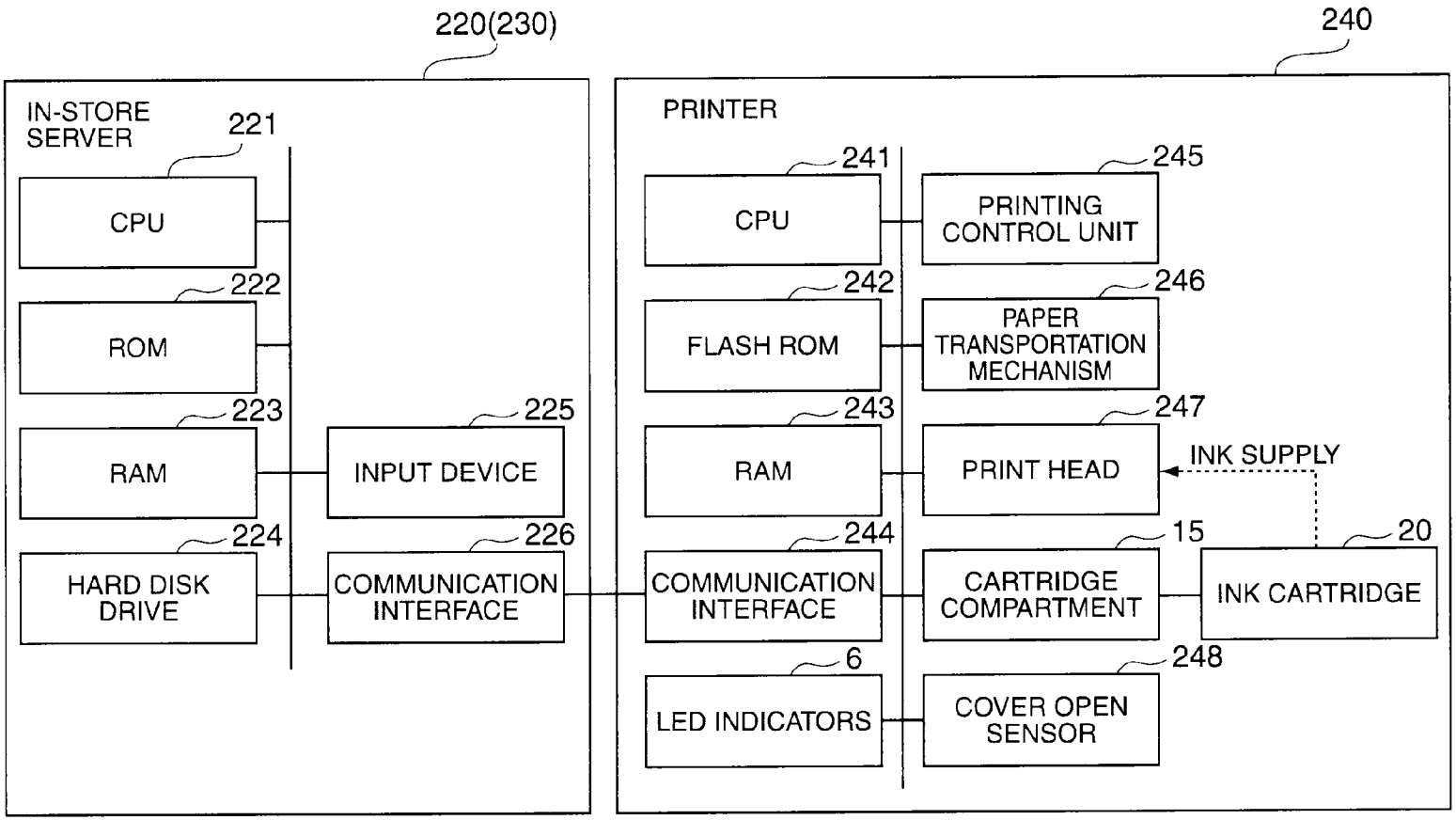
FIG. 5 is a schematic block diagram showing the arrangement of an in-store server and printer.

FIG. 5 is a schematic block diagram showing the arrangement of the in-store server 220 (230) and printer 240.

As shown in FIG. 5 the main parts of the in-store server 220 (including in-store server 230 and other servers) are the CPU 221, ROM 222 (nonvolatile memory), RAM 223 (volatile memory), a hard disk drive 224 as a large capacity storage device, an input device 225, and communication interface 226. The in-store server 220 (230) controls the printer 240 as a result of the CPU 221 running the operating system and software applications stored in the hard disk drive 224, and by sending commands and print data to the printer 240 through communication interface 226.

The printer 240 include, for example, a CPU 241, flash ROM 242 (rewritable nonvolatile memory), RAM 243 (volatile memory), communication interface 244, a printing control unit 245 for controlling discharging of ink onto the roll paper 11 to print images thereon, a paper transportation mechanism 246, print head 247, a cover open sensor 248 for detecting if the roll paper cover 5 or ink cartridge compartment cover 7 is open or closed, and a cartridge compartment 15 into which the ink cartridge 20 is loaded. The printer 240 receives commands and print data by communicating with the in-store server 220 (230) through the communication interface 244 while the CPU 241 runs firmware stored in flash ROM 242. Based on the received control commands and print data, the printing control unit 245 conveys roll paper 11 using the paper transportation mechanism 246 while driving the print head 247 to print on the roll paper 11 to issue coupons.

Printer Processes

Figure 6:
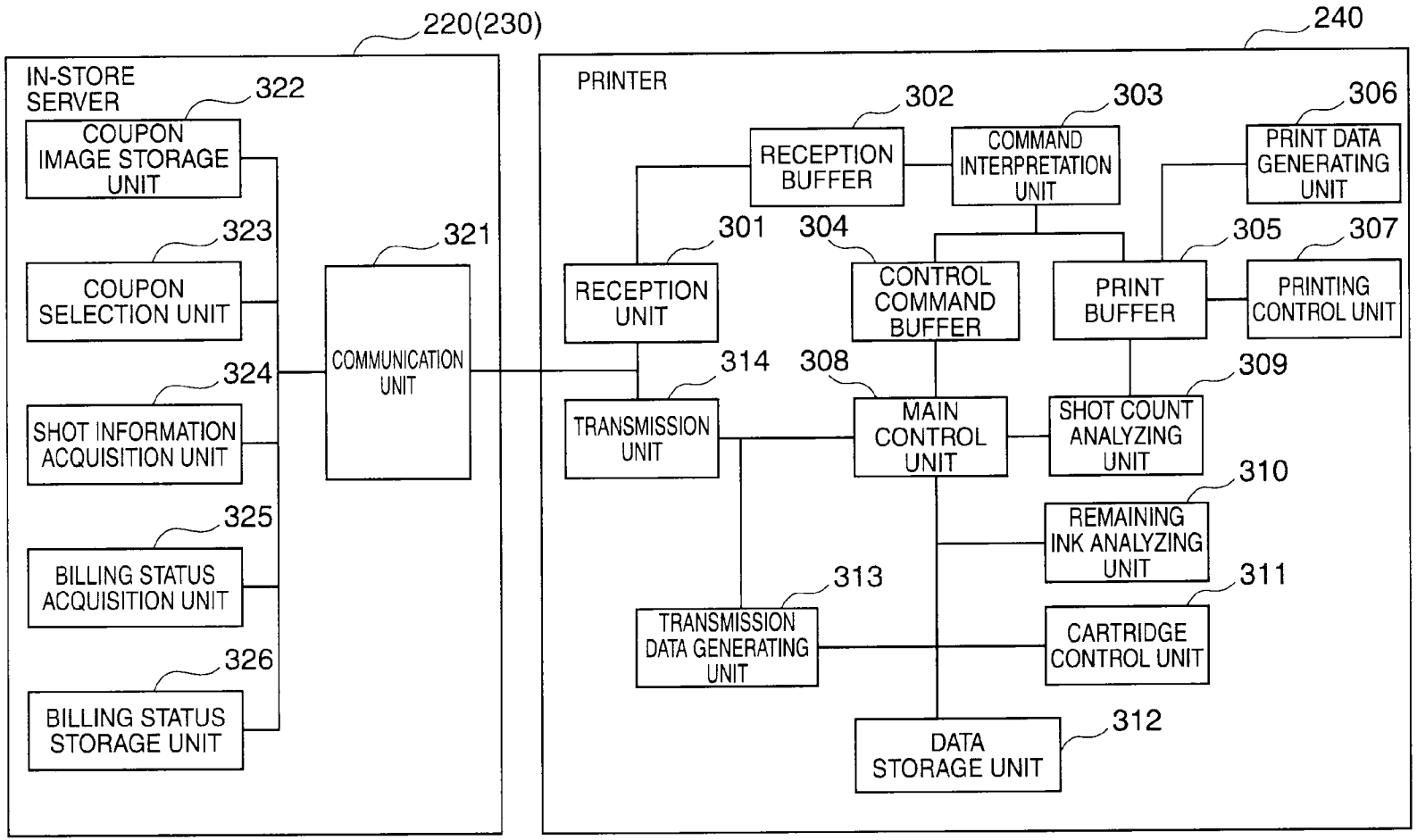
FIG. 6 is a function block diagram of internal processing by the in-store server and printer.

FIG. 6 is a function block diagram illustrating the internal processes of the in-store server 220 (230) and printer 240.

Operation of the printer 240 is described first. As shown in FIG. 6 the printer 240 has a reception unit 301 and a reception buffer 302. The reception unit 301 receives commands and print data sent from the in-store server 220. The reception buffer 302 temporarily stores the commands and print data received by the reception unit 301. A command interpretation unit 303 then interprets the data received in the reception buffer 302, and sends control commands to the control command buffer 304 and sends print data to the print buffer by direct memory access (DMA).

The print data buffered in the print buffer 305 is then converted for printing by the print data generating unit 306 to produce dot pattern data corresponding to the nozzle arrangement of the print head 247 and to store it in the print buffer. This dot pattern data is, for example, 2-bit gray scale data denoting whether the ink from the nozzles of the print head 247 is (1) not discharged, or discharged as a (2) small dot, (3) medium dot, or (4) large dot.

The printing control unit 307 drives the print head 247 based on the dot pattern data stored in print buffer 305 to form an image on the roll paper 11 and create a coupon.

The control command data buffered in the control command buffer 304 is read by the main control unit 308, which executes processes such as advancing the paper a specific distance based on the control commands.

The shot count analyzing unit 309 (ink usage calculation unit) is described next.

The shot count analyzing unit 309 counts the amount of ink discharged from the print head 247 as the number of shots of each color of ink in dot units based on the print data stored in the print buffer 305 or the dot pattern data generated from the print data. The amount of ink discharged from the print head 247 differs according to the size of each dot, that is, whether each dot is small, medium, or large. The shot count analyzing unit 309 converts each size of dot to a corresponding shot count, and calculates how many shots were discharged. The shot counts calculated by the shot count analyzing unit 309 are then stored in data storage unit 312. The cumulative shot count from a particular point in time, such as when the ink cartridge 20 is replaced, is also stored.

The shot count analyzing unit 309 counts the amount of ink discharged from the print head 247 to print on the roll paper 11 in dot units converted to a shot count for each color, and does not count (disregards) as part of ink usage the amount of ink consumed to ensure that the print head can discharge ink, including the ink discharged from the print head 247 during nozzle flushing, the ink vacuumed from the print head 247 by an ink suction mechanism not shown, and the ink used for clogged nozzle recovery and ink loading operations.

The remaining ink analyzing unit 310 is described next.

The remaining ink analyzing unit 310 calculates for each color the amount of ink remaining in the ink cartridge 20. A value denoting the amount of ink remaining in the ink cartridge 20 is stored for each color in the memory device 27 of the ink cartridge 20.

When the cartridge is recharged with ink, a specific initialization value is stored, and the amount of remaining ink can be calculated at any time by subtracting from this initial value the amount of ink used for printing plus the total amount of ink used to enable discharging ink from the print head, including the ink consumed by flushing, ink vacuuming, and other cleaning operations, and clogged nozzle recovery and ink loading operations as noted above.

The remaining ink level can alternatively be calculated from the total discharged shot count. The remaining ink level can also be expressed as the value of a ratio to the initialized value. The calculated remaining ink level is then stored in data storage unit 312 and in the memory device 27 of the ink cartridge 20 utilizing the cartridge control unit 311 at a predetermined time. When the remaining ink level becomes less than or equal to a specified level, the cartridge is considered empty (the "out-of-ink" level).

The cartridge control unit 311 is described next.

The cartridge control unit 311 is a control unit for controlling reading data from the memory device 27 of the ink cartridge 20 installed in the printer 240 and writing data to the memory device 27. The processes run by the cartridge control unit 311 are linked to the cartridge ID read from the installed ink cartridge as further described below.

The data storage unit 312 is described next with reference to FIG. 7 and FIG. 8.

The data storage unit 312 is a memory area for storing information about the printer 240 and can be created by reserving a specific area in flash ROM 242.

Figure 7:
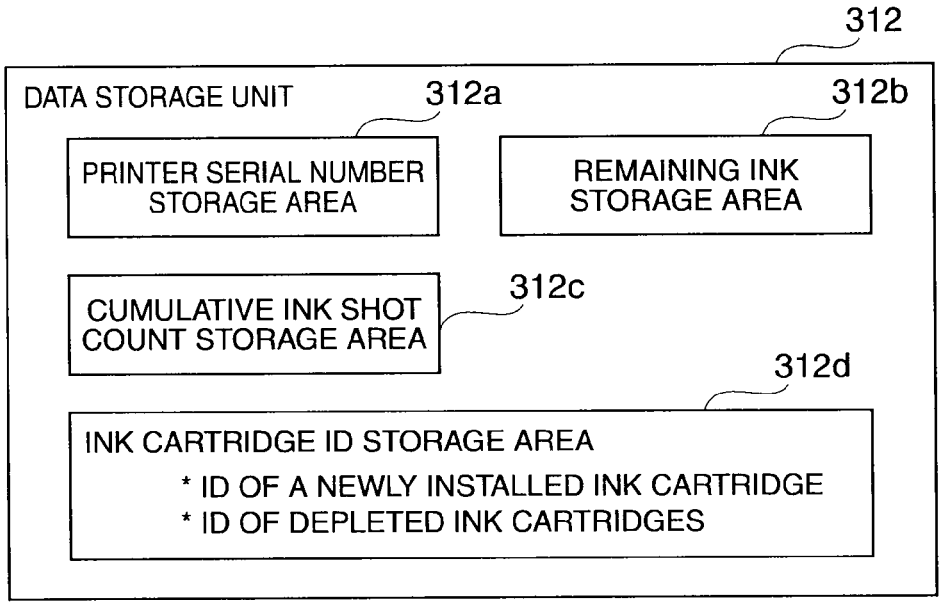
FIG. 7 schematically shows the storage areas in the data storage unit.

FIG. 7 schematically shows the storage areas in the data storage unit 312.

As shown in FIG. 7 the data storage unit 312 has a printer serial number storage area 312*a*, remaining ink storage area 312*b*, cumulative ink shot count storage area 312*c*, and ink cartridge ID storage area 312*d*.

The printer serial number storage area 312*a* stores a printer serial number (device identification number), which is a unique number for differentiating this printer 240 from other printers of the same or different model.

The remaining ink storage area 312*b* stores the amount of ink remaining in the ink cartridge currently loaded in the printer.

The cumulative ink shot count storage area 312*c* accumulates and stores the total number of shots used only for printing as counted by the shot count analyzing unit 309.

The ink cartridge ID storage area 312*d* stores the ID of the newly installed ink cartridge, and the ID of the empty ink cartridge that was replaced.

Figure 8:
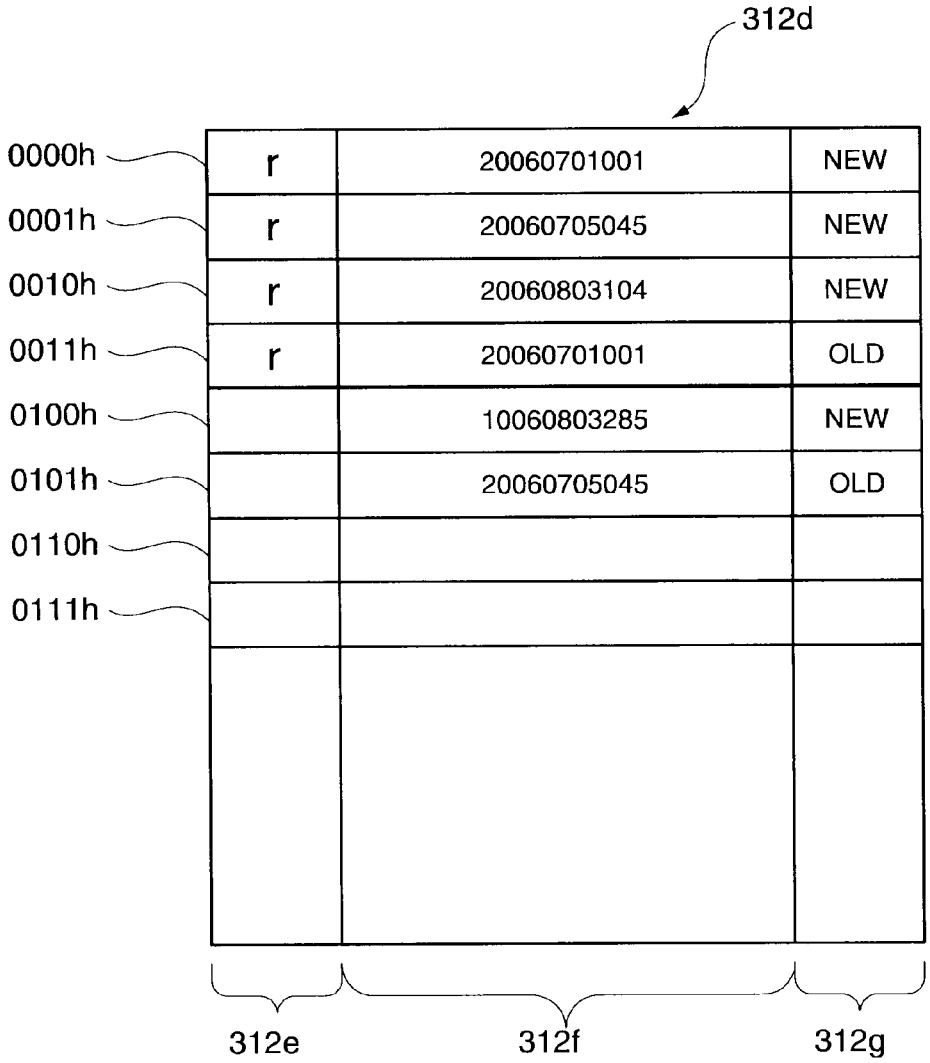
FIG. 8 schematically shows the ink cartridge ID storage area.

FIG. 8 schematically shows the ink cartridge ID storage area of the data storage unit 312.

The ink cartridge ID storage area 312*d* separately stores the ID of the newly installed ink cartridge and the ID of the replaced empty ink cartridge, and is configured to store both IDs. The ink cartridge ID storage area 312*d* is described below as having a limited capacity for storing ink cartridge identification numbers, but if a large capacity storage device is used for the data storage unit 312, the ink cartridge ID storage area 312*d* can be configured with no particular storage capacity limit.

The ink cartridge ID storage area 312*d* includes a flag unit 312*e*, an ink cartridge ID storage unit 312*f*, and an ink cartridge status storage unit 312*g*.

The flag unit 312*e* stores flags "r" (ID transmission status flag) indicating whether the ink cartridge ID has already been sent to the in-store server 220 (230).

The ink cartridge ID storage unit 312*f* stores the ink cartridge ID read from the memory device 27 by the cartridge control unit 311.

The ink cartridge status storage unit 312*g* stores the ink cartridge status as a designator representing either NEW or OLD. The ink cartridge status flag is used to determine whether the ink cartridge ID read from an ink cartridge is the ID number of an ink cartridge installed for the first time (NEW) or is the ID of an ink cartridge that reached the ink end (OLD).

In this embodiment of the invention the ink cartridge ID storage area 312*d* is configured to store data sequentially from a predetermined address (such as 0000h) each time the cartridge control unit 311 reads an ink cartridge ID from the memory device 27.

The transmission data generating unit 313 acquires the billing information (referred to below as the "billing status") stored in the data storage unit 312 of the printer 240 to produce the billing status information in response to a billing status transmission request from the in-store server 220 (230), or generates cumulative ink shot count information in response to a cumulative ink shot count transmission request, and returns the requested information to the in-store server 220 (230).

This billing status includes the new ink cartridge IDs as well as the IDs for empty ink cartridges stored in the ink cartridge ID storage area 312*d*. The printer serial number and remaining ink information can also be included.

The cumulative ink shot count information includes only the cumulative ink shot count used for printing (or the remaining ink level converted from the cumulative ink shot count).

Information including both this billing status information and the cumulative ink shot count information could alternatively be used as the billing status information. When the in-store server 220 (230) sends a transmission request in this case, the transmission data generating unit 313 returns information including both the billing status information and the cumulative ink shot count information as the requested billing status information.

When a billing status information transmission request is received, the transmission data generating unit 313 compiles this information into a single transmission unit, adds a checksum to improve data reliability, and returns the result as the billing status information. A checksum is also added to the cumulative ink shot count to return the cumulative ink shot count information. The resulting billing status information or cumulative ink shot count information is then sent through the transmission unit 314 to the in-store server 220 (230).

The transmission data generating unit 313 is not limited to sending the billing status information in one block and could instead sequentially send the printer serial number, remaining ink level, cumulative ink shot count, newly installed ink cartridge ID, and the empty ink cartridge IDs. The ink cartridge IDs can also be sent with other combinations of data, including only the cumulative ink shot count, thus improving transmission efficiency by transmitting only the necessary information.

Processing by the in-Store Server

The in-store server 220 (230) can execute various processes by running the operating system and software applications stored on the hard disk drive 224. A system for acquiring the coupon printing and billing status information using a printer 240 located in a store is shown in FIG. 6. The in-store server 220 (230) includes a communication unit 321, coupon image storage unit 322, coupon selection unit 323, shot information acquisition unit 324 (ink usage acquisition unit), billing status acquisition unit 325, and billing status storage unit 326.

The communication unit 321 communicates with the printer 240, and sends commands and print data to the printer 240 according to instructions from an upstream application or API (application programming interface) and receives information from the printer 240 through a port (a LAN port in this example) for communicating with the printer 240.

The coupon image storage unit 322 stores image data for the plural coupons that can be printed by the printer 240.

The coupon selection unit 323 selects the appropriate image data from the image data for the plural coupons stored in the coupon image storage unit 322. The coupon selection unit 323 in this embodiment executes the selection process when triggered by the POS terminal completing a transaction, for example.

More specifically, the coupon selection unit 323 selects image data for a coupon linked to a specific product purchased by the customer. The selected image data is sent through the communication unit 321 to the printer 240, which then prints and issues the coupon. As a result, coupons related to the products purchased by the customer are issued substantially at the same time as the receipt printer (not shown) connected to the POS terminal issues a sales receipt so that the coupons can be handed to the customer together with the receipt. By handing the coupons to the customer, the company Y 400 hopes to entice the customer to come again and make additional purchases. The coupon image data can be sent from the in-store server 220 (230) to the printer 240 for printing.

The shot information acquisition unit 324 requests the printer 240 to send the cumulative ink shot count information, and based on commands from a higher level application not shown sends the cumulative ink shot count information transmission request through the communication unit 321 to the printer 240. When the cumulative ink shot count information is received from the printer 240 after sending a cumulative ink shot count information transmission request, the cumulative ink shot count information is passed to the application that requested the information. A cumulative ink shot count information reception receipt is also returned to the printer 240. The cumulative ink shot count information is also stored in the billing status storage unit 326.

The billing status acquisition unit 325 requests the printer 240 to send the billing status information, and sends a billing status information transmission request through the communication unit 321 to the printer 240 when instructed by a higher level application, not shown. When the billing status information is received from the printer 240 after sending the billing status information transmission request, the billing status acquisition unit 325 passes the billing status information to the application. A billing status information reception receipt is also returned to the printer 240. The information in the received billing status information is interpreted and stored in the billing status storage unit 326.

When storing the information in the billing status information in the billing status storage unit 326, the billing status acquisition unit 325 stores the printer serial number, remaining ink level data, cumulative ink shot count, new ink cartridge ID, and old ink cartridge ID as a single record whether the billing status information is received as a single block or as separate pieces of data.

The shot information acquisition unit 324 and billing status acquisition unit 325 add a checksum or other error correction code to the total ink shot count information and billing status information. This error correction code is designed to ensure the integrity of a specific data unit, and is calculated by obtaining the checksum or the binary sum of all data, for example. Using an error correction code enables verifying whether the data has been modified by some other process or whether the data is correctly communicated to the printer manufacturer's terminal device 100, for example, so that retransmission or other error handling process can be executed if the value is different.

More specifically, by adding an error correction code to the billing status information, the billing status acquisition unit 325 prevents tampering and improves data reliability by enabling detecting errors in the received data.

This error correction code is added to the billing status information by the billing status acquisition unit 325 of the in-store server 220 (230) in this example, but the invention is not so limited. For example, the transmission data generating unit 313 of the printer 240 could add the error correction code to the billing status information so that billing status information containing an error correction code is sent from the printer to the in-store server 220 (230).

Figure 9:
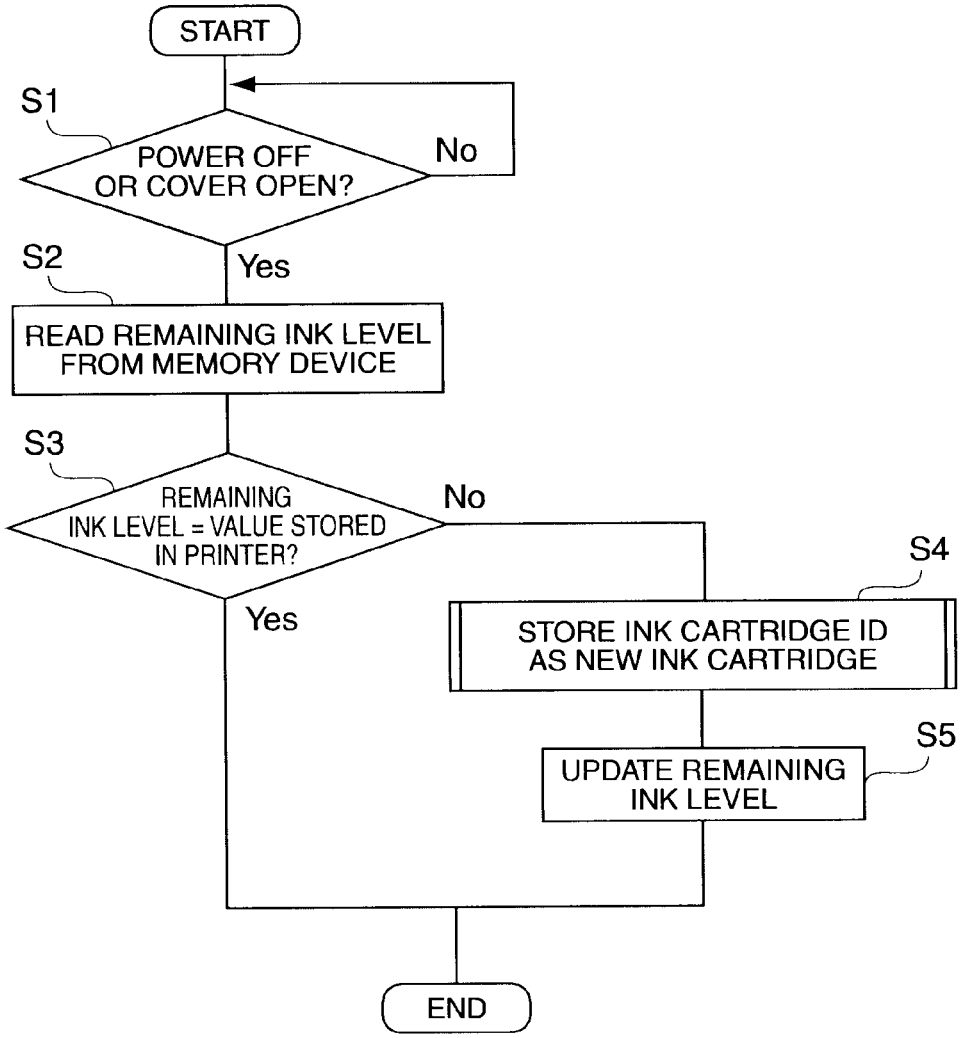
FIG. 9 is a flow chart describing the process executed when printer power turns on or an ink cartridge is installed.

Reading the Ink Cartridge ID by the Printer, Case 1: When a Cartridge is Installed A process for reading the ink cartridge ID when an ink cartridge 20 is installed in the printer 240 is described next with reference to the flow chart in FIG. 9. FIG. 9 is a flow chart describing the process that runs when the printer power is turned on or an ink cartridge is installed.

When a new ink cartridge 20 is installed in the printer 240, the cartridge control unit 311 reads the ink cartridge ID from the memory device 27 of the ink cartridge 20.

More specifically, when the printer 240 power turns on or when the cover open sensor 248 detects that the ink cartridge compartment cover 7 was closed (step S1 returns Yes), the remaining ink level value stored in the memory device 27 of the ink cartridge 20 is read (step S2) and compared with the remaining ink level value stored in the data storage unit 312 (step S3).

If the two remaining ink level values are the same, the currently installed ink cartridge is determined to be the same ink cartridge as before the power turned on or the ink cartridge was replaced.

If the remaining ink level values are not the same, the currently installed ink cartridge is different from the ink cartridge that was installed before the power turned on or the ink cartridge was installed, and the cartridge control unit 311 stores the ink cartridge ID read from the ink cartridge memory device 27 as the ID of a new ink cartridge (step S4).

After storing the new ink cartridge ID, the cartridge control unit 311 updates the remaining ink level value stored in the remaining ink storage area 312*b* of the data storage unit 312 to the value read from the memory device 27 of the ink cartridge 20 (step S5). As a result, the remaining ink level value stored in the ink cartridge 20 and the remaining ink level value stored by the printer 240 are the same.

The cartridge control unit 311 also increments and updates the installation counter stored in the memory device 27 of the ink cartridge 20. Information denoting the number of times the ink cartridge 20 has been installed in a printer is thus updated in the ink cartridge 20. The printer 240 can also read the value of this installation counter and execute an appropriate error handling process, such as notifying the in-store server 220, 230 that a problem has occurred, when the installation counter is a value that should not occur during normal use.

Figure 10:
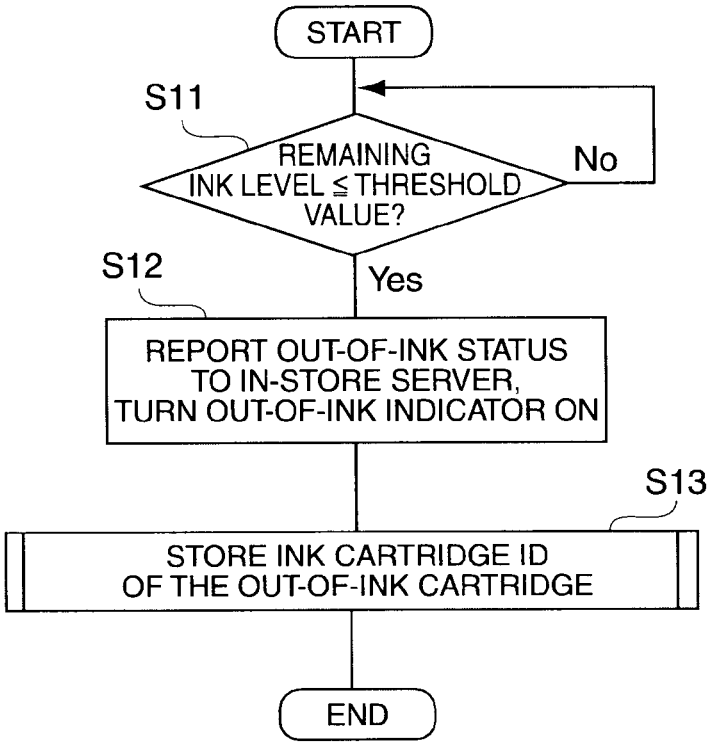
FIG. 10 is a flow chart describing the process executed when an ink cartridge is out of ink.

Reading the Ink Cartridge ID by the Printer, Case 2: When the Cartridge is Empty The ink cartridge ID reading process when the ink cartridge in the printer 240 is empty (out-of-ink state) is described next with reference to the flow chart in FIG. 10. FIG. 10 is a flow chart describing the process executed when an ink cartridge becomes empty.

The remaining ink analyzing unit 310 determines if an ink cartridge is empty is in this embodiment of the invention. The remaining ink analyzing unit 310 calculates the amount of remaining ink of each color in the ink cartridge 20 to obtain the remaining ink level value, and if the remaining ink level value is less than or equal to a predetermined value for any single color, the ink cartridge is determined to be in the out-of-ink state.

If the remaining ink level value is less than or equal to the predetermined level for any one color (step S11 returns Yes), the printer 240 reports an out-of-ink status to the in-store server 220 (230) using the transmission data generating unit 313, and causes an LED indicator 6 on the outside of the printer 240 to flash thereby prompting the user to replace the ink cartridge 20 (step S12).

The cartridge control unit 311 then reads the ink cartridge ID from the memory device 27 of the ink cartridge 20, and stores the read ink cartridge ID in the ink cartridge ID storage area 312*d* of the data storage unit 312 as the ID of an empty ink cartridge (step S13).

Storing the Ink Cartridge ID: When Installing an Ink Cartridge and When a Cartridge is Out-Of-Ink The ink cartridge ID storage process executed in step S4 in FIG. 9 and step S13 in FIG. 10 is described further with reference to FIG. 8 and FIG. 11.

Figure 11:
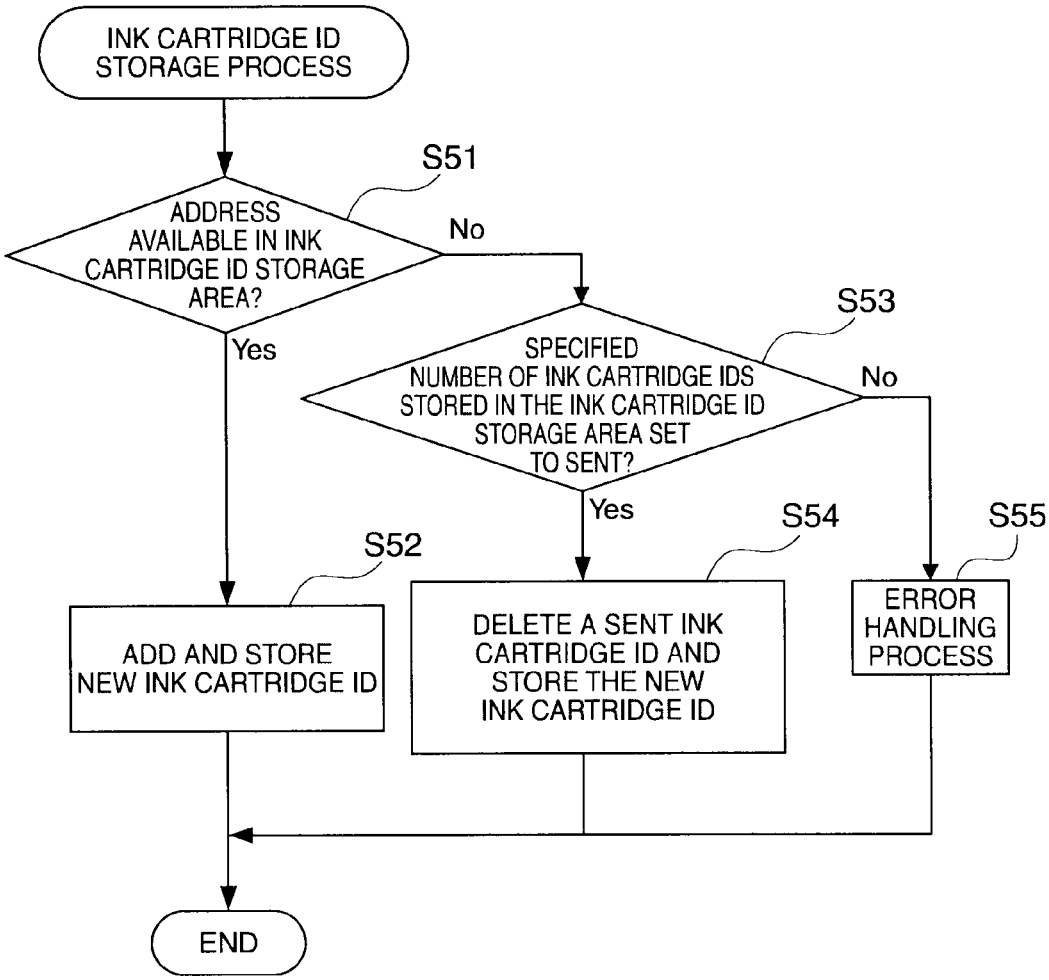
FIG. 11 is a flow chart of a process for storing the ink cartridge ID in the ink cartridge ID storage area.

Step S4 in FIG. 9 is the process for storing the ink cartridge ID when an ink cartridge is installed. FIG. 11 is a flow chart describing the process for storing the ink cartridge ID in the ink cartridge ID storage area 312*d*. The ink cartridge identification number (ID) storage capacity of the ink cartridge ID storage area 312*d* is assumed below to be limited to twenty ink cartridge IDs.

In this example a new ink cartridge is installed in the cartridge compartment 15 when four ink cartridge IDs are already stored in the ink cartridge ID storage area 312*d*. More specifically, in the example shown in FIG. 8 a new ink cartridge with ink cartridge ID 10060803285 is installed when new ink cartridge IDs 20060701001, 20060705045, and 20060803104 are stored at addresses 0000h, 0001h, and 0010h, and out-of-ink ink cartridge ID 20060701001 is stored at address 0011h.

The cartridge control unit 311 then determines if there is enough space in ink cartridge ID storage area 312*d* to store the ink cartridge ID read from the memory device 27. If there is (step S51 returns Yes), the ink cartridge ID of the newly installed ink cartridge is stored (step S52). More specifically, ink cartridge ID 10060803285 is written to address 0100h in the ink cartridge ID storage unit 312*f* and NEW or other specific flag (designator) is written to the corresponding field in the ink cartridge status storage unit 312*g*.

However, if step S51 determines no space is available (step S51 returns No), the cartridge control unit 311 determines if the twenty ink cartridge IDs stored in the ink cartridge ID storage area 312*d* have been sent by checking if the flag "r" is set in the flag unit 312*e*. If all twenty flags "r" are set (step S53 returns Yes), one of the twenty transmitted ink cartridge IDs is erased and the ink cartridge ID of the ink cartridge newly installed in the cartridge compartment 15 is stored to the ink cartridge ID storage area 312*d* (step S54).

Which of the twenty transmitted ink cartridge IDs to delete can be chosen, for example, on a FIFO (first in, first out) basis so that the oldest ink cartridge ID is deleted and the new ink cartridge ID is stored (overwritten) to the same address. Using the example shown in FIG. 8, the values stored at address 0000h in each storage unit would thus be erased, the ink cartridge ID for the newly installed ink cartridge would be written to the same 0000h address in the ink cartridge ID storage unit 312*f*, and NEW would be written to the same address in the ink cartridge status storage unit 312*g*.

If none of the twenty flags "r" is set in step S53 (step S53 returns No), a problem occurred. The cartridge control unit 311 therefore reports an error and executes an appropriate error handling process (step S55). More specifically, by running an error handling process instead of overwriting memory if the ink cartridge IDs stored in the ink cartridge ID storage unit 312*f* have not been sent to the in-store server 220 but the storage capacity is full, the ink cartridge IDs that have not been sent to the in-store server 220 can be reliably saved and not accidentally erased. The user can also be informed of a problem with the data storage unit 312 so that the user can have the printer repaired or checked by the printer manufacturer to keep the printing system running smoothly.

The ink cartridge ID storage process when the cartridge is out-of-ink in step S13 in FIG. 10 is described next. As shown in FIG. 8, when an ink cartridge installed in the cartridge compartment 15 runs out of ink, the cartridge control unit 311 reads the ink cartridge ID "20060705045", and determines if space is available in the ink cartridge ID storage area 312*d*. If there is (at address 0101h in this example) (step S51 returns Yes), the ink cartridge ID 20060705045 is stored at that address 0101h in ink cartridge ID storage unit 312*f* (step S52), and OLD is written to the same address in the ink cartridge status storage unit 312*g*.

If there is no available storage space (step S51 returns No), the cartridge control unit 311 determines if the twenty ink cartridge IDs stored in the ink cartridge ID storage area 312*d* have been sent by checking if the flag "r" is set in the flag unit 312*e*. If all twenty flags "r" are set (step S53 returns Yes), one of the twenty transmitted ink cartridge IDs is erased and the ink cartridge ID of the ink cartridge newly installed in the cartridge compartment 15 is stored to the ink cartridge ID storage area 312*d* (step S54). Which of the twenty transmitted ink cartridge IDs to delete is preferably determined on a FIFO (first in, first out) basis in this situation, too, so that the oldest ink cartridge ID is deleted and the new ink cartridge ID is stored (overwritten) to the same address.

When an ink cartridge reaches the out-of-ink state, the in-store server 220 (230) stops printing from the printer 240 until the ink cartridge is replaced. When the user replaces the ink cartridge after the ID for the out-of-ink ink cartridge is stored, the sequence shown in FIG. 9 causes the printer 240 to recognize the new ink cartridge and resume printing if the new ink cartridge is not also empty.

Instead of deleting ink cartridge IDs that have been sent to the in-store server 220, this embodiment of the invention thus stores new ink cartridge IDs read from the memory device 27 of the ink cartridge in the ink cartridge ID storage area 312*d* by adding the IDs to memory. As a result, if the ink cartridge IDs received by the in-store server 220 are later lost because the in-store server 220 crashed after receiving the ink cartridge IDs, for example, the required ink cartridge IDs can be recovered by the in-store server 220 sending another transmission request to the printer because the transmitted ink cartridge IDs are still stored in the ink cartridge ID storage area 312*d* on the printer.

More specifically, because both the printer 240 and the in-store server 220 store the ink cartridge IDs, the printing system can be operated stably without losing the ink cartridge IDs even if a problem develops on the printing system.

Furthermore, when there is no available storage space in the ink cartridge ID storage area 312*d*, new ink cartridge IDs are stored in FIFO order by sequentially deleting the oldest ink cartridge ID for which the transmission flag "r" is set. The invention can therefore be used in printing systems that use different ink cartridges for each color and therefore frequently read and store the ink cartridge IDs.

The ink cartridge IDs thus stored in the printer 240 are then collected in the in-store server and eventually reported to the terminal device 100 of the printer manufacturer by the process described below. The ink cartridge ID collection process is described below.

Acquiring Billing Status Information from the Printer

The billing status information including the total ink shot count is sent from the printer 240 to the in-store server 220 (230) in response to a command from the in-store server 220 (230). As described above, the billing status information includes the printer serial number, remaining ink level, total ink shot count, the ink cartridge IDs for new ink cartridges, and the ink cartridge IDs for out-of-ink cartridges, and the in-store server 220 (230) collates this information into a billing status information report with an error correction code. At a predetermined time, the billing status information is then collected on the main server 210, and the billing status information on the main server 210 is sent periodically to the printer manufacturer's terminal device 100. The printer manufacturer's terminal device 100 (the printer manufacturer) can then determine ink usage by the printers 240 and the condition of each ink cartridge 20.

Figure 12:
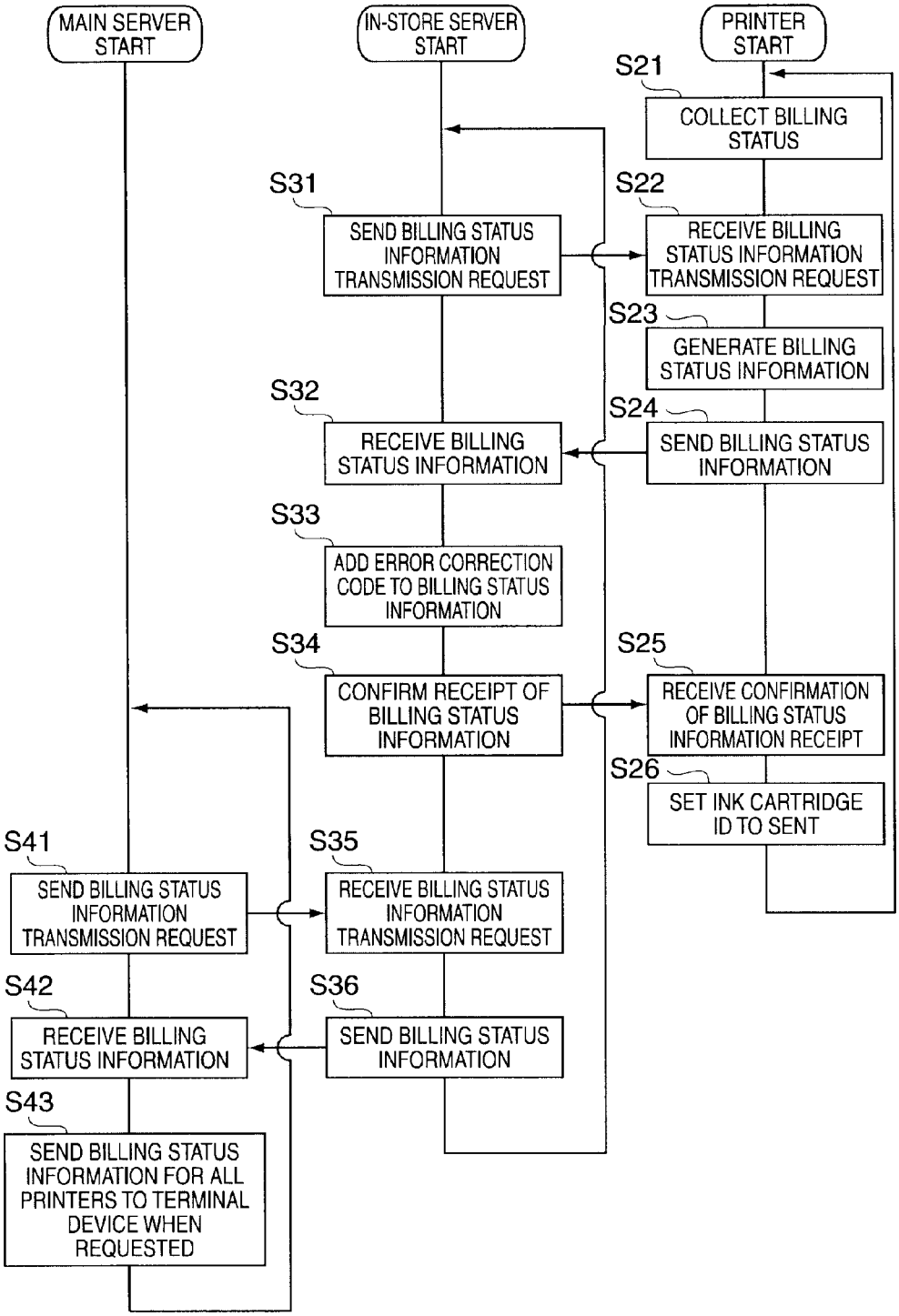
FIG. 12 is a flow chart of the billing status information collection process.

The process of collecting the billing status information is described in further detail below with reference to the flow chart thereof in FIG. 12.

First, each printer 240 counts the total number of shots using the shot count analyzing unit 309, and collects all ink cartridge IDs stored in the ink cartridge ID storage area 312*d*, including newly installed ink cartridges 20 and cartridges 20 that are out-of-ink, by means of the remaining ink analyzing unit 310 and cartridge control unit 311, and thus collects the billing status information (step S21).

The in-store server 220 (230) collects the billing status information from each of the printers 240 at a predetermined time by sending a billing status information transmission request to all of the printers 240 in the store (step S31).

When a printer 240 receives the billing status information transmission request (step S22), the printer 240 reads the information needed to report the billing status from the data storage unit 312 and adds a checksum to produce the billing status information (step S23). The transmission data generating unit 313 then sends the resulting billing status information through the transmission unit 314 to the in-store server 220 (230) (step S24).

When the in-store server 220 (230) receives billing status information from a printer 240 (step S32), the server adds an error correction code to assure data reliability to the received billing status information if a checksum is not included in the received billing status information, and temporarily stores the information (step S33). After step S33, the in-store server 220 (230) sends a confirmation acknowledging receipt of the billing status information to the printer 240 (step S34).

When the printer 240 receives confirmation of the billing status information (step S25), the printer 240 sets transmitted ink cartridge IDs stored in the ink cartridge ID storage area 312*d* (step S26) as having been sent. More specifically, the printer 240 sets the transmission flag "r" in the flag unit 312*e*.

Referring again to FIG. 8, the ink cartridge IDs 20060701001, 20060705045, 20060803104, and 20060701001 for which the transmission flag "r" is set were previously sent to the in-store server, but when sending the billing status information all ink cartridge IDs, including these four previously sent IDs and the new ink cartridge IDs 10060803285 and 20060705045, and cartridge status flags from address 0000h to address 0101h are sent to the in-store server 220. When the printer 240 then receives the billing status information confirmation from the in-store server 220 (230), the printer 240 sets the transmission flags "r" in the flag unit 312*e* at the addresses 0100h and 0101h where the new ink cartridge IDs 10060803285 and 20060705045 are stored.

By thus setting the transmission flag when receipt of the billing status information is confirmed, the printer 240 can easily determine whether a stored ink cartridge ID is an ink cartridge ID that has already been sent or is an ink cartridge ID that has not been sent. As a result, the printer 240 can also prevent accidentally writing a new ink cartridge ID at the address of an ink cartridge ID that has not been sent. Writing to the data storage unit 312 can therefore be controlled more accurately because the printer 240 separates write-protected addresses (for which the transmission flag "r" is not set) from writable addresses (for which the transmission flag "r" is not set) in the ink cartridge ID storage area 312*d*.

After setting the transmission flag for transmitted ink cartridge IDs in step S26, the printer 240 returns to step S21, collects the billing status information, and repeats steps S22 to S26. As a result, each time a billing status information transmission request is received, the printer 240 sends the billing status information to the in-store server 220 (230), and adds and stores any subsequently read ink cartridge ID.

At a predetermined time after the in-store server 220 (230) collects the billing status information from the printers 240, the main server 210 sends a billing status information transmission request requesting transmission of the billing status information to the in-store server 220 (230) (step S41).

When a billing status information transmission request (step S35) is received, the in-store server 220, 230 sends the stored billing status information to the main server 210 (step S36). When the main server 210 receives billing status information from an in-store server 220, 230 (step S42), the main server 210 stores the billing status information. As a result, billing status information is collected by the main server 210 from all printers 240 insofar as the printers 240 are operating normally, that is, unless there is a problem with a particular printer 240 or a printer 240 is turned off.

When requested by the terminal device 100 of the printer manufacturer, the main server 210 or the operator of the main server 210 at company X sends the billing status information collected from all printers to the printer manufacturer or the terminal device 100 used by the printer manufacturer (step S43). The billing status information can be sent on-line electronically to the terminal device 100 used by the printer manufacturer, or the billing status information could be recorded to a recordable data storage medium such as a CD or DVD that is delivered to the printer manufacturer. As a result, all billing status information stored on the main server 210 is transmitted or delivered to the printer manufacturer or the terminal device 100 designated by the printer manufacturer.

Requests from the terminal device 100 of the printer manufacturer do not need to be processed on demand. Alternatively, the company X 200 could assemble the billing status information according to a predetermined monthly schedule and send the monthly billing status information to the terminal device 100 designated by the printer manufacturer by a certain date each month, for example.

Because an error correction code is automatically added to the billing status information on the in-store server 220 (230) in this billing status information collection model, data errors can be detected if an error occurs during transmission between the main server 210 and terminal device 100 designated by the printer manufacturer and the accuracy of the data can be assured. Tampering can also be detected and handled appropriately because tampering will cause a mismatch between the error correction code and the content of the billing status information.

Tabulation by the Printer Manufacturer

The terminal device 100 of the printer manufacturer uses the ink shot count and the ink cartridge ID information in the billing status information for different purposes.

The ink shot count is described first.

The ink shot count indicates how much ink was used by each printer 240 each month, for example, and billing is based on this ink shot count.

FIG. 13A to FIG. 13D show the ink shot counts from the billing status information received by the printer manufacturer's terminal device 100 from the main server 210 of company X 200. For brevity, the invention is used in an ink billing system having a maximum of three printers in this example. FIG. 13A shows the ink shot count tabulation data for the period from the introduction of the ink billing system to 2006 Jul. 1, and FIG. 13B to FIG. 13D show the ink shot count tabulation data for the respective one month periods starting 2006 Aug. 1. For brevity the total ink shot counts are not shown for each color in FIG. 13A to FIG. 13D, and the total ink shot count for all colors combined are shown by way of example.

As shown in FIG. 13A, two printers were in used as of 2006 Jul. 1. The "previous count" in each table in FIG. 13 is the total ink shot count as of the last tabulation, and is 0 in FIG. 13A because the billing system was just introduced. The "received count" is based on the billing status information received by the terminal device 100 designated by the printer manufacturer from the main server 210 (company X) for the current billing (tabulation) cycle, and the "difference" is the difference of the received count minus the previous count. The "current count" is a value corresponding to the ink shot count used by each printer 240 as known to the terminal device 100 designated by the printer manufacturer based on the received count at the current tabulation date, and is normally equal to the current received count. This "current count" becomes the previous count that is the basis for the next tabulation.

Each printer 240 stores the cumulative ink shot count calculated from the start of operation, and reports this cumulative ink shot count to the terminal device 100 designated by the printer manufacturer at each tabulation date. As a result, ink usage from the previous tabulation date to the current tabulation date is denoted by the "difference" value in each table.

The total of these differential counts obtained for each printer 240 therefore denotes the total ink usage by company X 200 from the previous tabulation to the current tabulation. The terminal device 100 of the printer manufacturer can therefore determine the billing amount from the previous tabulation to the current tabulation, that is, the current billing period, by multiplying the ink cost per shot times this total ink usage. The terminal device 100 of the printer manufacturer then sends a bill based on this billing amount to the company X 200, and the company X 200 remits payment for the invoiced amount to the printer manufacturer.

The data table in FIG. 13B shows that the number of printers has increased from the number of printers reporting in FIG. 13A. This is because a new printer was added to the printing system by company X and an ink shot count carrying a printer serial number corresponding to the new printer is transmitted with the billing status information. A new printer record based on this information is therefore added to the data table, and the customer is billed based on the total number of ink shots reported by all printers, including the new printer.

If billing status information is not reported by a particular printer 240 for some reason, such as the printer 240 being turned off when the data is reported, the record for that printer is blank as shown in FIG. 13C. The difference field is therefore also blank (equals 0), not included in the total count, and the current count of that printer 240 for the current billing period is the previous count.

When billing status information is received for the same printer 240 the next time the billing status information is reported as shown in FIG. 13D, the received count is the total ink shot count for two billing periods, and the ink usage that was not previously reported or billed for is added to the current billing amount.

This data collection and tabulation process assures that the printer manufacturer can reliably bill the customer for ink usage by each printer 240 even when the printers 240 are located remotely to the printer manufacturer. If billing status information is not received from a particular printer 240 for a certain period of time, a problem may have occurred and an inquiry can also be initiated.

The ink cartridge ID is described next.

The ink cartridge IDs that are sent with the billing status information indicate whether the ink cartridge was positively installed in a printer 240 and whether the ink cartridge was used continuously until it ran out of ink.

FIG. 14 shows the ink cartridge IDs from the billing status information received by the terminal device 100 designated by the printer manufacturer from the main server 210 (company X 200).

In the table shown in FIG. 14 the ink cartridge IDs of the ink cartridges shipped to company X 200 by the printer manufacturer are stored together with the shipping date based on the shipping records maintained by the terminal device 100 of the printer manufacturer. Whether an ink cartridge was used or not is recorded based on the ink cartridge IDs contained in the received billing status information. More specifically, when the ink cartridge ID of a newly installed ink cartridge or the ink cartridge ID of an out-of-ink ink cartridge is received, the ink cartridge IDs are stored in the "date of first use" and "out-of-ink date" fields. This date of first use and the out-of-ink date can be approximate dates, and if date the billing status information is collected from the printers 240 is included in the billing status information, the data collection date can be recorded.

Furthermore, if an ink cartridge ID and dates received by the terminal device 100 of the printer manufacturer match a previously received ink cartridge ID and dates, the terminal device 100 knows that the ink cartridge ID and dates were already received, therefore ignores the ink cartridge ID and dates, and records only the ink cartridge IDs and dates that are received for the first time.

By thus compiling this ink cartridge data table, the terminal device 100 of the printer manufacturer can determine the status of ink cartridges shipped from the printer manufacturer to company X.

Except for the initial introduction, the terminal device 100 of the printer manufacturer can statistically predict the cycle from ink cartridge shipping to use and final collection by the printer manufacturer as data is collected and tabulated. Ink cartridges that deviate from this cycle and are not used or are not recovered by the printer manufacturer even though the cartridge is empty can then be investigated to determine what if any problem there is.

This embodiment of the invention is described with reference to an ink cartridge that contains multiple colors of ink in a single cartridge, but the invention is not so limited and can be applied to ink cartridges containing only one color of ink.

The invention is also described using by way of example an inkjet printer and ink cartridge, but the invention is not so limited and can be used with laser printers and toner cartridges, for example, by using a value that can be converted to toner usage, such as a charging time, instead of the ink shot count.

Printer Repairs

Identifying each printer, that is, each printer serial number, when billing based on the ink shot count in order to count the total number of ink shots for each printer 240. Each printer 240 also cumulatively counts the number of ink shots since the printer 240 is first used, and the total count since the printer was first used will be lost if the total count buffer is cleared.

If a printer 240 needs repair necessitating replacing the control circuit board containing the flash ROM or other memory device storing the printer serial number and ink shot count, the billing status information including the printer serial number, ink shot count, an ink cartridge ID is preferably read from the circuit board being replaced and written to the new circuit board being installed.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printer in communication with a data processing apparatus, the printer printing images based on commands received from the data processing apparatus, the printer comprising:

a data storage unit that stores information including a device identification number identifying the printer;

a cartridge compartment that holds a cartridge that stores ink;

a cartridge control unit that reads a cartridge identification number from a memory device contained in the cartridge and that stores the cartridge identification number in the data storage unit;

an ink usage calculation unit that calculates an ink usage amount and that stores the ink usage amount in the data storage unit;

a transmission data generating unit that generates status information, which includes the cartridge identification number, the device identification number and the ink usage amount stored in the data storage unit; and a transmission unit that sends the status information to the data processing apparatus.

2. The printer described in claim 1, wherein:

the cartridge stores a plurality of inks; and the ink usage calculation unit calculates an ink usage amount for each of the inks and stores in the data storage unit the ink usage amount for each of the inks.

3. The printer described in claim 1, wherein:

the ink usage calculation unit calculates the ink usage amount by counting the number of ink shots discharged.

4. The printer described in claim 3, wherein the ink usage calculation unit disregards the amount of ink used to enable the print head to discharge ink when calculating the ink usage amount.

5. A printer in communication with a data processing apparatus, the printer printing images based on commands received from the data processing apparatus, the printer comprising:

a data storage unit that stores information;

a cartridge compartment that holds a cartridge that stores ink;

a cartridge control unit that reads a cartridge identification number from a memory device contained in the cartridge and that stores the cartridge identification number in the data storage unit;

a transmission data generating unit that generates status information, which includes the cartridge identification number stored in the data storage unit; and a transmission unit that sends the status information to data processing apparatus;

wherein the cartridge control unit reads the cartridge identification number and stores the cartridge identification number and a designator representing a newly installed cartridge in the data storage unit when a cartridge is installed in the cartridge compartment.

6. A printer in communication with a data processing apparatus, the printer printing images based on commands received from the data processing apparatus, the printer comprising:

a data storage unit that stores information;

a cartridge compartment that holds a cartridge that stores ink;

a cartridge control unit that reads a cartridge identification number from a memory device contained in the cartridge and that stores the cartridge identification number in the data storage unit;

a transmission data generating unit that generates status information, which includes the cartridge identification number stored in the data storage unit; and a transmission unit that sends the status information to the data processing apparatus;

wherein the cartridge control unit reads the cartridge identification number when the amount of ink inside the cartridge becomes less than or equal to a predetermined level, and stores the cartridge identification number and a designator representing a cartridge that is out of ink.

7. A printer communication with a data processing apparatus, the printer printing images based on commands received from the data processing apparatus, the printer comprising:

a data storage unit that stores information;

a cartridge compartment that holds a cartridge that stores ink;

a cartridge control unit that reads a cartridge identification number from a memory device contained in the cartridge and that stores the cartridge identification number in the data storage unit;

a transmission data generating unit that generates status information which includes the cartridge identification number stored in the data storage unit; and a transmission unit that sends the status information to the data processing apparatus;

wherein the cartridge control unit retains the cartridge identification number stored in the data storage unit when the transmission unit sends the status information to the data processing apparatus, sets a transmission status of the cartridge identified by the transmitted cartridge identification number to denote sent, and stores the transmission status in the data storage unit.

8. The printer described in claim 7, wherein the cartridge control unit deletes from the data storage unit a cartridge identification number of a cartridge for which the transmission status is set to denote sent, and stores the cartridge identification number of a newly installed cartridge in the data storage unit.

9. The printer described in claim 7, wherein a storage capacity limit is set for cartridge identification numbers that can be stored in the data storage unit, and the cartridge control unit executes an error handling process if storage of cartridge identification numbers reaches the storage capacity limit and all transmission status flags are not set to denote sent when storing a cartridge identification number.

* * * * *